US006371900B1

(12) United States Patent
Kurisu et al.

(10) Patent No.: US 6,371,900 B1
(45) Date of Patent: Apr. 16, 2002

(54) COOLING DRUM FOR TWIN-DRUM CONTINUOUS CASTING MACHINE

(75) Inventors: Yasushi Kurisu; Kazuto Yamamura; Katsumi Ando; Keiji Tsunenari; Chihiro Yamaji, all of Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/413,842

(22) Filed: Oct. 6, 1999

(30) Foreign Application Priority Data

Dec. 4, 1998 (JP) ..... 10-345083

(51) Int. Cl.[7] ..... F28F 5/02
(52) U.S. Cl. ..... 492/46; 492/54
(58) Field of Search ..... 492/46, 16, 54; 164/138, 423, 427, 428, 429, 463, 479, 480

(56) References Cited

U.S. PATENT DOCUMENTS 4,951,736 A 8/1990 Yukumoto et al. ..... 164/428

FOREIGN PATENT DOCUMENTS

| | | |
|---|---|---|
| GB | 2099399 | 12/1982 |
| JP | 5-154616 | 6/1993 |
| WO | WO 9852706 | 11/1998 |

OTHER PUBLICATIONS

Patent Abstracts of Japan, vol. 014, No. 224 (M–0972), May 11, 1990 & JP 02 055645 A (Kawasaki Steel Corp.), Feb. 26, 1900.

Patent Abstracts of Japan, vol. 017, No. 548 (M–1490), Oct. 4, 1993 & JP 05 154616 A (Nippon Stainleee Steel Co., LTD.: Others: 01), Jun. 22, 1993.

Patent Abstracts of Japan, vol. 1995, No. 03, Apr. 28, 1995 & JP 06 335751 A (Mitsubishi Heavy Ind., Ltd.: Others: 01), Dec. 6, 1994.

*Primary Examiner*—S. Thomas Hughes
*Assistant Examiner*—Marc W. Butler
(74) *Attorney, Agent, or Firm*—Kenyon & Kenyon

(57) ABSTRACT

A cooling drum for a twin-drum continuous casting machine is capable of ensuring an excellent drum body interior cooling effect and advantageously overcoming both the problem of wear of the cooling drum end portions that are pressure-contacted with, and slide on, the side dams and the problem of their local deformation, and that, as a result, can ensure long-term maintenance of a suitable pressure-contact sliding state between the side dams and the cooling drum so as to enable stable continuous casting over a prolonged period. The cooling drum comprises a drum body portion of a material having a thermal conductivity of 100–400 W/mK and drum end portions part or all of whose portions in pressure-contact with the side dams and/or part or all of whose inner regions are formed of a reinforcing material that is a high-hardness material having a Vickers hardness HV (250 g) of 300–600.

19 Claims, 12 Drawing Sheets

COOLING DRUM FOR TWIN-DRUM CONTINUOUS CASTING MACHINE

BACKGROUND OF THE INVENTION

1. Field of the Invention

The present invention relates to a cooling drum used in a twin-drum continuous casting machine.

2. Description of the Related Art

As shown in FIGS. 21(*a*) and 21(*b*), a well-known, conventional twin-drum continuous casting machine, for example, has a moving mold formed by a pair of rotating cooling drums 1*a,* 1*b* and a pair of side dams 2, 2 abutting on opposite end portions (faces) of the drums. Molten steel 6 is supplied from a tundish 4 into the moving mold 3 through a nozzle 5. A molten pool 3*p* of a prescribed level is formed in the moving mold 3 while the molten steel is simultaneously cooled by the pair of drums 1*a,* 1*b* to progressively form solidified shells 6*s,* 6*s*'. The solidified shells 6*s,* 6*s*' are forced together and integrated at the gap portion formed at the most proximate points of the cooling drums 1*a,* 1*b,* thereby continuously casting a slab 6*c*. The drum end portions are generally given a projecting shape for sealing in the molten steel.

In order to ensure formation of excellent shells 6*s,* 6*s*' by promoting cooling of the molten steel 6 at the outer peripheral surfaces of the cooling drums 1*a,* 1*b* used in this twin-drum continuous casting machine, the cooling drums 1*a,* 1*b* are generally made of copper or a copper alloy with good thermal conductivity. They are also equipped with internal cooling structures 7 and shaft 1*s* so as make them resistant to thermal load.

As shown in FIGS. 21(*a*) and 21(*b*), each of the end portions of the cooling drums is formed with an end portion 1*t*. The end surfaces of the end portions 1*t* press against the side dams 2, 2 and are worn as they slide thereon during rotation. Irregular gaps are apt to arise between the end portions 1*t* and the side dams 2, particularly when the side dams 2 experience vibration or thermal deformation. The molten steel invades and solidifies in these gaps to make the sliding surfaces rough. This abruptly degrades the molten steel sealing performance of the sliding surfaces and spoils the shape of the slab edge portion. It also deforms the shapes of the end portions 1*t* and the side dams 2, further aggravating wear and shortening their service life. This makes it impossible to realize stable continuous casting operation over a long period.

For overcoming this problem, JP-A-(unexamined published Japanese patent application) 6-335751, for example, discloses a technique of coating the end portions (faces) of the cooling drums with surface layers exhibiting high-strength, wear resistance and lubricity, e.g., layers composed of Co—Cr—Al—Y-system alloy, tungsten carbide (WC) or the like. However, this alone does not curb the deformation and wear occurring at the cooling drum end portions to an extent that readily enables stable continuous casting operation.

SUMMARY OF THE INVENTION

An object of the present invention is to provide a cooling drum for a twin-drum continuous casting machine that is capable of ensuring an excellent drum body interior cooling effect and advantageously overcoming both the problem of wear of the cooling drum end portions that are pressure-contacted with, and slide on, the side dams and the problem of their local deformation, and that, as a result, can ensure long-term maintenance of a suitable pressure-contact sliding state between the side dams and the cooling drum so as to enable stable continuous casting over a prolonged period.

In one of its aspects, the present invention provides:

(1) A cooling drum for a twin-drum continuous casting machine equipped with a pair of cooling drums that rotate in opposite directions and a pair of side dams that abut on opposite end faces of the cooling drums to define a moving mold, the cooling drum comprising a drum body portion formed of a material having high thermal conductivity and end portions formed of a material having higher hardness than the material of the body portion.

In another of its aspects, the present invention provides:

(2) A cooling drum for a twin-drum continuous casting machine equipped with a pair of cooling drums that rotate in opposite directions and a pair of side dams in pressure-contact with opposite end faces of the cooling drums, the cooling drum comprising a drum body portion of a material having a thermal conductivity of 100–400 W/mK and drum end portions part or all of whose portions in pressure-contact with the side dams and/or part or all of whose inner regions are formed of a reinforcing material that is a high-hardness material having a Vickers hardness: Hv (250 g) of 300–600.

In another of its aspects, the present invention provides:

(3) A cooling drum for a twin-drum continuous casting machine according to (1) above, wherein the drum body portion is formed of copper or a copper alloy.

In another of its aspects, the present invention provides:

(4) A cooling drum for a twin-drum continuous casting machine according to (1) above, wherein the high-hardness material forming the end portions is material of the body portion which has been subjected to a nitriding or a carbonizing high-hardness treatment.

In another of its aspects, the present invention provides:

(5) A cooling drum for a twin-drum continuous casting machine according to (1) above, wherein the high-hardness material forming the end portions is material of the body portion welded to a cladding material.

In another of its aspects, the present invention provides:

(6) A cooling drum for a twin-drum continuous casting machine according to (1) above, wherein the high-hardness material of the end portions is coated with a super high hardness material to a thickness of 10–500 $\mu$m by flame spraying or plating.

In another of its aspects, the present invention provides:

(7) A cooling drum for a twin-drum continuous casting machine according to (1) above, wherein an outer peripheral surface of the drum body portion or an outer peripheral surface of the drum body portion and outer peripheral surfaces of the end portions are coated with heat conducting layers having a thermal conductivity of not less than 30 W/mK and a thickness of 10–5000 $\mu$m by flame spraying or plating.

In another of its aspects, the present invention provides:

(8) A cooling drum for a twin-drum continuous casting machine according to (2) above, wherein the ratio of the coefficient of thermal expansion of the reinforcing material to that of the drum body portion material is 0.5 to 1.2.

In another of its aspects, the present invention provides:

(9) A cooling drum for a twin-drum continuous casting machine according to (2) above, wherein the reinforcing material is formed of one or more of stainless steel, high-Mn cast steel, Ni—Cr—Mo steel and Inconel.

In another of its aspects, the present invention provides:

(10) A cooling drum for a twin-drum continuous casting machine according to (2) above, wherein the reinforcing material formed at the inner regions of the drum end portions is detachably fastened mechanically to the drum body portion material.

In another of its aspects, the present invention provides:

(11) A cooling drum for a twin-drum continuous casting machine according to (2) above, wherein the reinforcing material formed at the drum end portions is joined to the drum body portion material directly or through an intervening plating layer.

In another of its aspects, the present invention provides:

(12) A cooling drum for a twin-drum continuous casting machine according to (2) above, wherein the reinforcing material formed at the drum end portions is integrated with a cladding material that is joined to the drum body portion material and is composed of a material similar to the drum body portion material.

In another of its aspects, the present invention provides:

(13) A cooling drum for a twin-drum continuous casting machine according to (2) above, wherein the reinforcing material formed at the drum end portions is coated on the drum body portion material directly or through an intervening plating layer by weld-overlaying or flame spraying.

In another of its aspects, the present invention provides:

(14) A cooling drum for a twin-drum continuous casting machine according to (11) above, wherein the reinforcing material formed at the drum end portions is supported by reinforcing material provided at the inner regions of the drum end portions.

In another of its aspects, the present invention provides:

(15) A cooling drum for a twin-drum continuous casting machine according to (2) above, wherein the reinforcing material formed at the drum end portions and the reinforcing material formed at the inner regions of the end portions are integrally formed, the reinforcing material formed at the drum end portions is welded to the drum body portion material through an intervening plating layer, and the reinforcing material formed at the inner regions of the drum end portions is detachably fastened mechanically to the drum body portion material.

In another of its aspects, the present invention provides:

(16) A cooling drum for a twin-drum continuous casting machine according to (2) above, wherein the reinforcing material formed at the inner regions of the drum end portions is segmented in the circumferential direction or radial direction.

In another of its aspects, the present invention provides:

(17) A cooling drum for a twin-drum continuous casting machine according to (1) above, wherein at least outermost surface layers of the drum end portions that are pressure-contacted with and slide on the side dams are coated with super-high hardness material layers of a thickness of 10–500 $\mu$m and a Vickers hardness: Hv (250 g) of 600–1000 by flame spraying or plating.

In another of its aspects, the present invention provides:

(18) A cooling drum for a twin-drum continuous casting machine according to (2) above, wherein the reinforcing material is provided with a cooling structure.

In another of its aspects, the present invention provides:

(19) A cooling drum for a twin-drum continuous casting machine according to (18) above, wherein the cooling structure of the reinforcing material is one or a combination of two or more of a heat pipe, a water-cooling structure and an effusion cooling structure.

DESCRIPTION OF THE PREFERRED EMBODIMENTS

Figure 1:
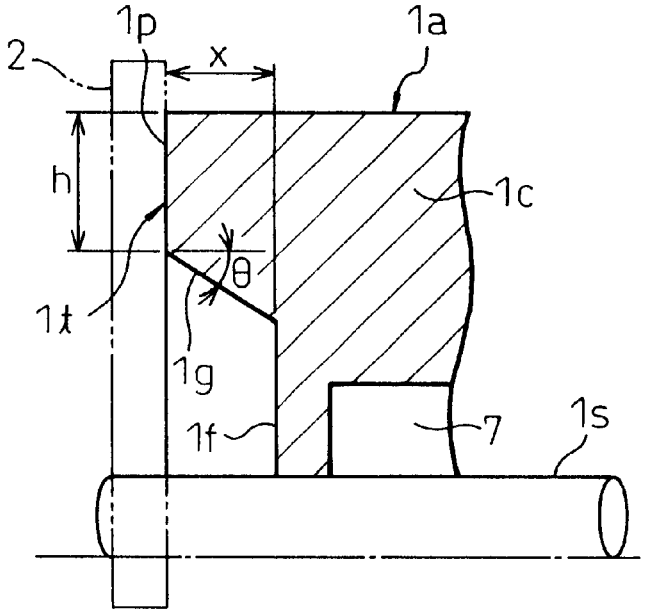
FIG. 1 is an explanatory side sectional view of an example of the end portion structure of a cooling drum to which the present invention is applied.

The present invention relates to a cooling drum used in a twin-drum continuous casting machine and is directed to achieving wear resistance at the end portions of the cooling drum that slide on the side dams and to overcoming the problem of local deformation of the end portions. It is basically directed to forming the end portions of the cooling drum end portions that are pressure-contacted with and slide on the side dams of wear resistant material.

The inventors conducted experiments regarding the conditions necessary for achieving stably sustainable molten steel sealing property between the end portions of the cooling drum and the side dams. They learned, as a result, that the end portions of the cooling drum are easily deformed by the abnormal load produced by the pressure contact and sliding of the end portions on the side dams and the biting the solidified shell. From this they learned that the desired stable molten steel sealing performance cannot be achieved merely by satisfying the wear resistance requirement. The present invention was accomplished based on this knowledge.

In the present invention, deformation and wear of the end portions of the cooling drum are curbed by forming regions thereof extending to a depth (thickness) of 1–10 mm from the end portion surfaces that contact the side dams and the solidified shells, i.e., the surfaces thereof that are susceptible to deformation and wear, of high-hardness material having a hardness (Hv) that is twice or more the hardness of the body portion material. In addition, the body portion is formed of a material of high thermal conductivity so as to enable the cooling effect of the internal cooling structure also to operate to cool the end portions, thereby reducing their thermal load. As these measures reduce the overall deformation and wear of the end portions, the present invention enables the cooling drum to maintain its configurational properties over the long term, whereby it becomes possible to realize stable continuous casting.

As specific measures, first, a material having a thermal conductivity of not less than 100 W/mK is used as the material of the drum body portion so as to optimize the internal cooling effect with respect to the cooling drum. This prolongs the service life of the body material because, by keeping its temperature low, it reduces the amount of thermal stress produced. Further, by ensuring thorough cooling of the body portion material, it also contributes to cooling of the drum end portions and thus also reduces their thermal load. When the thermal conductivity of the material is less than 100 W/mK, the internal cooling effect is insufficient for effectively cooling the molten steel to form the solidified shells and continuous casting becomes impossible.

Materials currently available for use as drum body portion materials include copper, copper alloys, super heat-resistant alloys, stainless steel (SUS), high-Mn cast steel and high-Cr cast iron. Among these, copper or copper alloys thereof have the highest thermal conductivity. As it is practically difficult to obtain a higher thermal conductivity than that offered by these materials, from the viewpoint of thermal conductivity it should be preferable to use copper or a copper alloy having the thermal conductivity not less than 100 W/mK. However, copper or copper alloy is inferior to other materials in mechanical strength, heat resistance and wear resistance.

When copper or copper alloy is used, therefore, the drum end portions that pressure-contact with and slide on the side dams must be formed of an appropriate material other than copper in order for compensate for the drawbacks of copper or copper alloy.

The deformation and wear of the end faces of the cooling drum according to the present invention are affected by the material forming the side dams. As the present invention is more concerned with enabling long-term use of the expensive cooling drum than of the side dams, the faces of the side dams that are in sliding contact with the end portions of the cooling drum are made of a material having lower hardness than the end faces of the cooling drum, e.g., of a ceramic material of a Vickers hardness: Hv (250 g) of 50–300.

As means for reinforcing the drum end portions, part or all of the drum end portions or part or all of the inner regions of the drum end portions are formed of a high-hardness material having a Vickers hardness: Hv (250 g) of 300–600.

When the hardness is less than a Vickers hardness Hv (250 g) of 300, the mechanical strength of the drum end portions is insufficient. When the surfaces that make pressure-contact with and slide on the side dams are formed of such a material, their wear resistance is insufficient and service life short. Use of a material of a Vickers hardness: Hv (250 g) of greater than 600 is undesirable owing to its low toughness and susceptibility to cracking.

High-hardness materials meeting these conditions include stainless steels excelling in deformation resistance and wear resistance (SUS410, SUS440A, SUS301, SUS630 etc.), high-Mn cast steel (SCMnH11), Ni—Cr—Mo steel (SCNCM 616), Inconel (718, 750, 706). These can be used individually or in combinations of two or more. All have Vickers hardness: Hv (250 g) of 300 or higher and are excellent in deformation resistance (strength) and wear resistance. As such, they are appropriate reinforcing materials.

It is advantageous to make the boundary region between the reinforcing material at the drum end portions and the material of drum body portion tight and robust so that the drum end portions can enjoy the cooling effect from the drum body portion material. As the method of forming the reinforcing material on the drum end portions it is therefore preferable to employ flame spraying, weld-overlaying or joining (including, for example, any of various types of ordinary welding, explosion pressure welding, thermal pressure welding, brazing, diffusion welding, HIP and electron beam welding).

Otherwise, the end face regions can be imparted with high hardness twice or more that of the body portion by nitriding treatment or carbonizing treatment. It is also possible to form the surfaces of the end faces with a high-hardness material of twice or more the hardness of the body portion by cladding or coating (flame spraying or plating) or by welding.

In order to ensure stable union between the high-hardness material and the material of the body portion, the coefficient of thermal expansion of the high-hardness material should preferably be one that minimizes the thermal expansion differential between the high-hardness material and the body portion material. Specifically, the high-hardness material preferably has a coefficient of thermal expansion that is within the range of 50–120% that of the body material.

To facilitate union between the reinforcing material and the end portions, both the outer peripheral surface of the drum body portion and the outer peripheral surfaces of the end portions are preferably continuously coated with a heat conducting layer having a thermal conductivity of not less than 30 W/mK and a thickness of 10–5000 $\mu$m by flame spraying or plating. The layer does not permit easy union at a thickness of less than 10 $\mu$m and is liable to peel at a thickness of greater than 5000 $\mu$m. When the thermal conductivity is less than 30 W/mK, little cooling effect reaches the drum end portions.

The cooling drum can be equipped internally with a cooling structure, such as a water-cooling structure or an effusion cooling structure. In addition, a heat pipe can be equipped internally with the reinforcing material. This helps to lower the thermal load on the reinforcing material and maintain its functionality over the long term. It also increases the uniformity of temperature distribution in the axial and radial directions of the drum.

Methods available for joining (forming) the high-hardness material include:

(1) Producing a cladding material of the high-hardness material and an intermediate material (of the same composition as the body portion material) and joining it to the body portion material by welding.

Cladding methods:

Explosion pressure welding, thermal pressure welding, brazing, diffusion welding and Cu casting (for preventing degradation of the clad portion by dispersion of copper into the cladding interface in this case, it is effective to introduce an intervening Ni foil or a plating layer). When producing the cladding material, it is preferable to avoid making the cladding interface between the high-hardness material and the intermediate material flat but to give the high-hardness material a distinctive shape like, for example, T, E, L or II. This helps to prevent peeling owing to difference in coefficient of thermal expansion and to enhance the strength of the union.

Welding methods:

Electron beam welding, laser beam welding (2) Direct joining of high-hardness material to the body portion.

Joining: Explosion pressure welding, thermal pressure welding, brazing

Plating: Electroplating, dipping (3) Other:

Imparting high hardness to the end portions faces by surface treatment

Surface treatment:

Nitriding or carbonization treatment

The conditions of the joining (forming) by the aforesaid joining (forming) methods are selected in light of the nature of the material of the cooling drum body portion and the nature of the material of the cooling drum end portions.

To avoid interface peeling when the reinforcing material is formed on the drum body portion material by welding, weld-overlaying or joining in this manner, the ratio of the coefficient of thermal expansion of the reinforcing material to that of the drum body portion material is preferably in the range of 0.5 to 1.2. The ratio of the coefficient of thermal expansion of the reinforcing material to the intermediate material between the reinforcing material and the body portion material and the ratio of the coefficient of thermal expansion of the intermediate material to the body portion material are also preferably in the range of 0.5 to 1.2.

When reinforcing material is formed at part of the drum end portions and the inner regions of the drum end portions, the reinforcing material can be fabricated beforehand and detachably fastened mechanically (bolt fastening or force-fitting) at the inner regions of the drum end portions.

When the reinforcing material is formed at part of the drum end portions and the inner regions of the drum a send portions, the reinforcing material formed at the drum end portions and that formed at the inner regions of the end portions can be formed independently or can be formed integrally from the start. Otherwise they can be formed independently and then integrally joined.

For avoiding deformation and cracking during fabrication, it is effective to segment at least the reinforcing material formed at the inner regions of the drum end portions. As the shape of the segmented reinforcing material is stable, it can be stably fastened and deformation thereof during operation can be mitigated. The reinforcing material can be segmented in the circumferential direction, the radial direction or both the circumferential and radial directions.

Among the reinforcing materials set out in the foregoing, stainless steel, while having enough mechanical strength to prevent local deformation of the drum end portions, is relatively low in hardness. Because of this, its wear resistance may be insufficient if the side dam surfaces on which the drum end portions slide are made of a ceramic material with a Vickers hardness: Hv (250 g) on the 300 level. In such a case, the surface of the reinforcing material formed on the drum end portions (faces) is preferably coated by flame spraying or plating to a thickness in the range of 10–500 $\mu$m with tribaloy. WC-NiCr, $Cr_3C_2$ cermet or other such a super high hardness material having a Vickers hardness: Hv (250 g) on the 600–1000 level. When the coating has a thickness of less than 10 $\mu$m it readily wears and cannot easily be given a long service life. When it has a thickness of greater than 500 $\mu$m, it tends to peel.

As explained in the foregoing, the present invention forms the drum body portion of a material having high thermal conductivity so as to enhance the cooling effect of the internal cooling structure. It also forms the drum end portions or the drum end portions and the inner regions of the drum end portions of a reinforcing material that is a material of high hardness so as to reinforce the hardness of the drum end portions and enhance their wear resistance in proportion. By this, the shape of the drum end portions can be maintained over the long term and the molten steel sealing property between the drum end portions and the side dams can be stably maintained. Stable continuous casting can therefore be realized.

EXAMPLES

Structures of the cooling drum according to different embodiments of the present invention will now be explained with reference to the drawings.

In FIG. 1, reference symbol 1*a* designates a typical conventional cooling drum. Each end portion (only one shown) of the cooling drum 1*a* that makes contact with a side dam 2 is formed with a ring-like projecting portion 1*t* of a width x of 1–10 mm and height h of 1–20 mm. Between the end face 1*p* of the projecting portion 1*t* and the end face 1*f* of the body portion 1*c* is formed an inclined surface 1*g* whose angle of inclination θ is less than 80 degrees. The body portion 1*c* is equipped with a cooling structure 7 equipped the cooling pipe 1*s*. In the present invention, the material for forming the cooling drum 1*a* are differentiated between the body portion 1*c* and the projecting portion 1*t*.

Example 1

Figure 2:
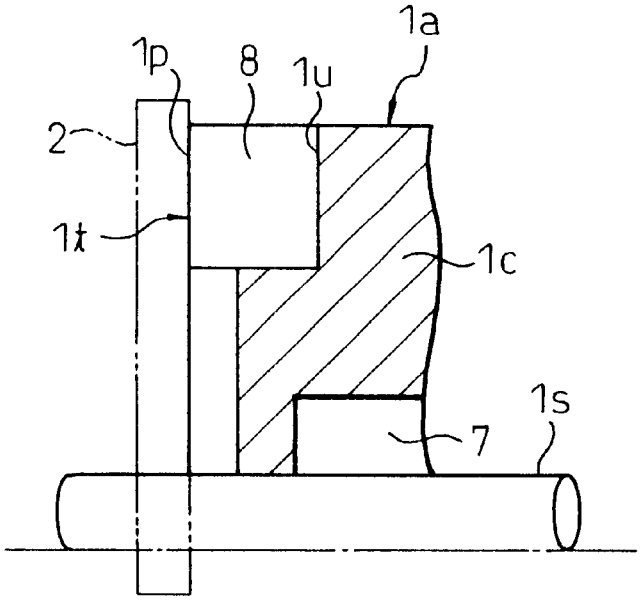
FIG. 2 is an explanatory side sectional view of the end portion structure of a cooling drum that is an embodiment of the present invention.

FIG. 2 shows the structure of one end of a cooling drum that is a basic embodiment of the present invention. As the structure at the other end is identical, it is not separately illustrated or explained in this or the following embodiments. In this embodiment, the body portion 1*c* is made of a Cu alloy material having a thermal conductivity of 350 W/mK, a hardness: Hv of 150 and a coefficient of thermal expansion of $18\times10^{-6}$/° C. The projecting portion 1*t* is made of a Ni-system super heat-resistant alloy 8 having a thermal conductivity of 12 W/mK and a coefficient of thermal expansion of $13\times10^{-6}$/° C. As it has a high hardness (Hv: 400), it is more resistant to deformation and wear than the Cu alloy. More specifically, the Ni-system super heat-resistant alloy 8 is a ring-like member whose width is 10–500% of the end portion width and whose height is 10–100% that of the end portion height h. It is fitted on and diffusion welded to a shoulder portion of the body portion 1*c* to form the projecting portion 1*t* of the end portion of the cooling drum 1*a*.

In this embodiment, the end portion (end face 1*p*) of the cooling drum 1*a* that contacts the side dam 2 is formed by the high-hardness Ni-system super heat-resistant alloy 8 and is therefore resistant to deformation and wear by contact with the side dam 2 or by the solidified shell. Moreover, the body portion 1*c* is formed of a Cu alloy material that is excellent in thermal conductivity. Since the end portion therefore also enjoys the cooling effect of the cooling structure 7 via the medium of the Cu alloy material, the thermal load of the end portion is reduced. Compared with the case of forming the end portion (end face 1*p*) of Cu alloy material, for example, the amount of deformation and wear can be reduced.

Example 2

Figure 3:
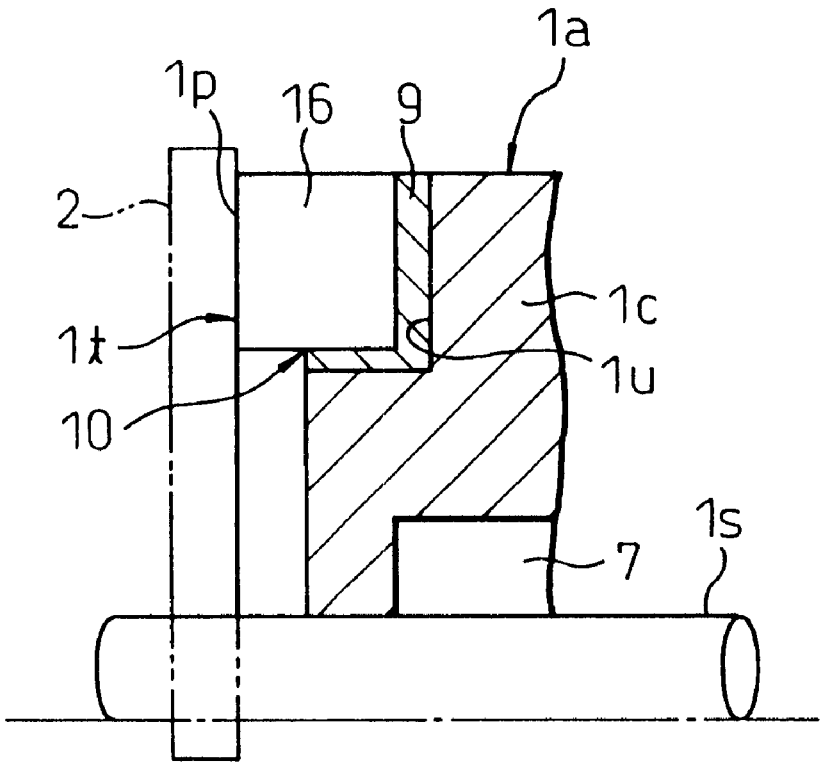
FIG. 3 is an explanatory side sectional view of the end portion structure of a cooling drum that is another embodiment of the present invention.
Figure 4A:
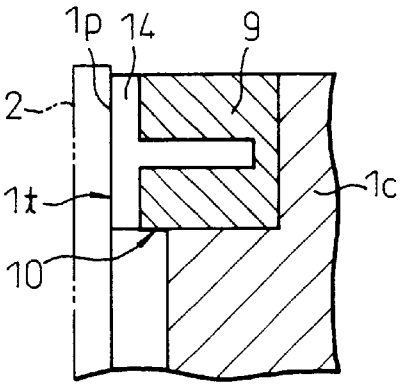
FIGS. 4(*a*)–(*f*) are a set of explanatory side sectional views of cladding materials that can be used in the embodiment of FIG. 3.
Figure 4B:
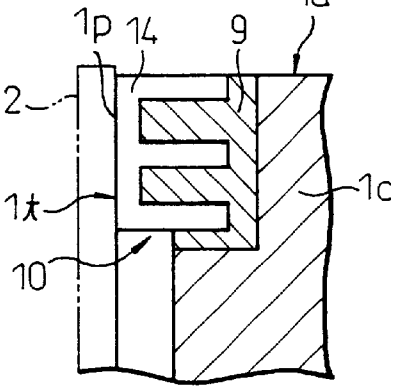
Figure 4C:
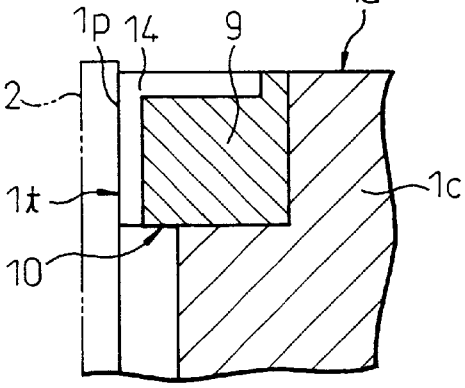
Figure 4D:
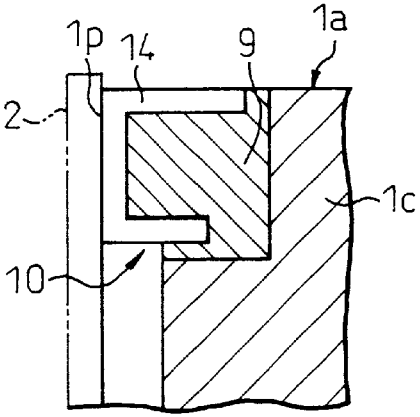
Figure 4E:
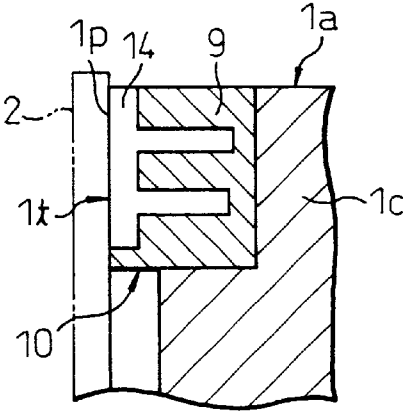
Figure 4F:
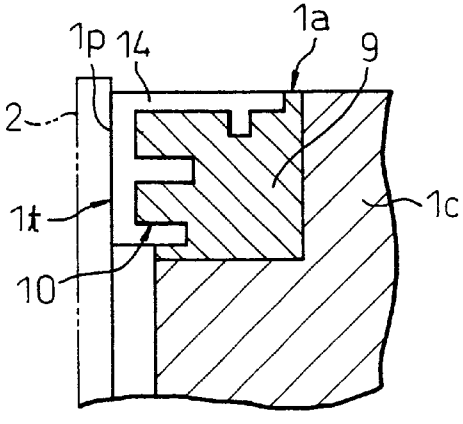

FIG. 3 shows the structure of a cooling drum that is another embodiment of the present invention. In this embodiment, the body portion 1*c* is made of a Cu alloy material having a thermal conductivity of 350 W/mK, a hardness: Hv of 150 and a coefficient of thermal expansion of $18\times10^{-6}$/° C. The projecting portion 1*t* is made of Cu alloy 9 constituting an intermediate material and a cladding material 10 composed of a deformation/wear resistant stainless steel material 16 having a thermal conductivity of 25 W/mK, a coefficient of thermal expansion of $10\times10^{-6}$/° C. and a higher hardness (Hv: 400) than the Cu alloy 9. More specifically, the cladding material 10 is a ring-like member whose width is 10–500% of the end portion width x and whose height is 10–100% that of the end portion height h. It is welded to the Cu alloy 9 at the Cu alloy material end portion of the body portion 1*c* to form the projecting portion 1*t* at the end portion of the cooling drum 1*a*.

In this embodiment, the end portion (end face 1*p*) of the cooling drum 1*a* that contacts the side dam 2 is formed by the stainless steel material 16 and is therefore resistant to deformation and wear by contact with the side dam 2 or by the solidified shell. Moreover, the body portion 1*c* is formed of a Cu alloy material that is excellent in thermal conductivity. Since the end portion therefore also enjoys the cooling effect of the cooling structure 7 via the medium of the Cu alloy 9 material, the thermal load of the end portion is reduced. Compared with the case of forming the end portion (end face 1*p*) of Cu alloy material, for example, the amount of deformation and wear can be reduced.

The high-hardness material and the intermediate material of the cladding material 10 sustain a peeling force at their interface owing to the difference in their coefficients of thermal expansion. To prevent peeling, the union at the interface is therefore preferably strengthened by giving the high-hardness material a distinctive shape other than flat. As shown in FIGS. 4(*a*)–4(*f*), preferable shapes include, for example, T, E, L or II and the like.

Example 3

Figure 5:
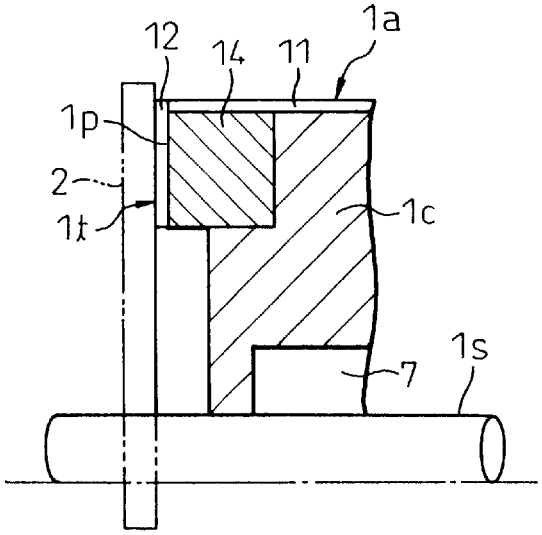
FIG. 5 is an explanatory side sectional view of the end portion structure of a cooling drum that is another embodiment of the present invention.

FIG. 5 shows a cooling drum 1*a* whose body portion 1*c* is formed of Cu material, for example, and whose end portion projecting portion 1*t* is formed of a stainless steel material 8. The outer peripheral surfaces of the projecting portion 1*t* and the body portion 1*c* are coated with a Ni plating layer 11. The cooling drum end face 1*p*, which faces the side dam 2 and is formed of the stainless steel material 8 and the Ni plating layer 11, is flame-sprayed with tribaloy 12 whose hardness Hv of 700 is greater than that of the stainless steel material 8 and the Ni plating layer 11.

In this embodiment, the end portion (end face 1*p*) of the cooling drum 1*a* that contacts the side dam 2 is formed by the flame-sprayed layer of high-hardness tribaloy 12 and is therefore resistant to deformation and wear by contact with the side dam 2 or with the solidified shell. Moreover, the body portion 1*c* is formed of a Cu alloy material that is excellent in thermal conductivity. Since the end portion therefore also enjoys the cooling effect of the cooling structure 7 via the medium of the Cu alloy material and the stainless steel material 14, the thermal load of the end portion is reduced. Compared with the case of forming the end portion (end face 1*p*) of Cu alloy material, for example, the amount of deformation and wear can be reduced.

Example 4

Figure 6A:
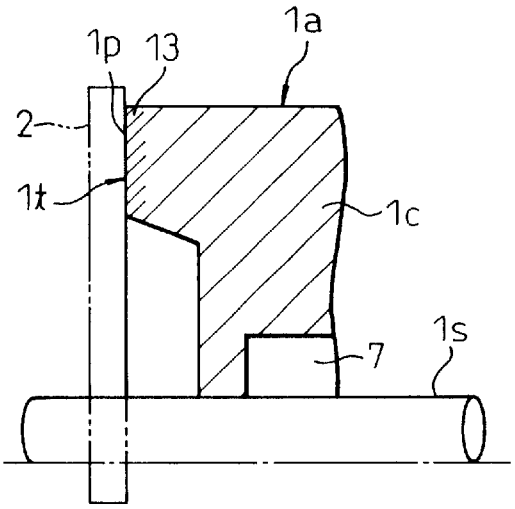
FIGS. 6(*a*), (*b*) are a set of explanatory side sectional views of two structures wherein the end surfaces of cooling drums that are embodiments of the present invention are imparted with high hardness by nitriding surface treatment.
Figure 6B:
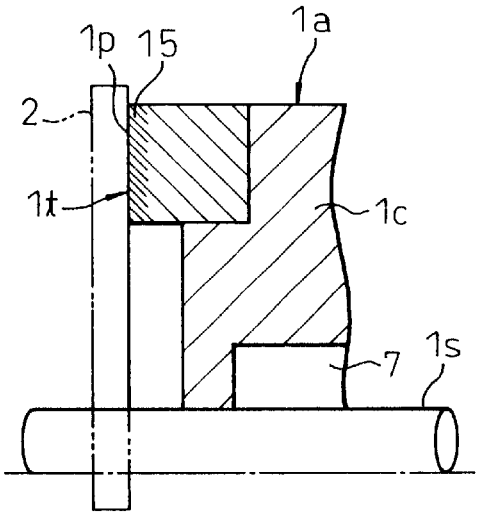

In the embodiment shown in FIG. 6(*a*), the body portion 1*c* is, for instance, formed of a Cu alloy material having a thermal conductivity of 350 W/mK, a hardness Hv of 150 and a coefficient of thermal expansion of $18\times10^{-6}$/° C., while the end face 1*p* of the end portion projecting portion 1*t* is formed by nitriding to a depth of 500 μm from its surface with a nitrided layer 13 of a hardness Hv of 500. No joining is required in this embodiment.

In this embodiment, the end portion (end face 1*p*) of the cooling drum 1*a* that contacts the side dam 2 is formed by the nitrided layer 13 to have greater hardness than the body portion 1*c*. It is therefore resistant to deformation and wear by contact with the side dam 2 or with the solidified shell. Moreover, the body portion 1*c* is formed of a Cu alloy material that is excellent in thermal conductivity. Since the end portion therefore also enjoys the cooling effect of the cooling structure 7, the thermal load of the end portion is reduced. Compared with the case of not forming the end portion (end face 1*p*) with the nitrided layer 13, for example, the amount of deformation and wear can be reduced to about 1%.

In the embodiment shown in FIG. 6(*b*), the body portion 1*c* is, for instance, formed of a Cu alloy material, the end portion projecting portion 1*t* is formed of a stainless steel material 14 having a thermal conductivity of 25 W/mK, a hardness Hv of 400 and a coefficient of thermal expansion of $18\times10^{-6}/°$ C., and the end face 1*p* of the projecting portion 1*t* is formed by nitriding to a depth of 100 $\mu$m from its surface with a nitrided layer 15 of a hardness Hv of 600.

In this embodiment, the end portion (end face 1*p*) of the cooling drum 1*a* that contacts the side dam 2 is formed by the nitrided layer 15 to have greater hardness than the Cu alloy material of the body portion 1*c*. It is therefore resistant to deformation and wear by contact with the side dam 2 or with the solidified shell. Moreover, the body portion 1*c* is formed of a Cu alloy material that is excellent in thermal conductivity. Since the end portion therefore also enjoys the cooling effect of the cooling structure 7, the thermal load of the end portion is reduced. Compared with the case of a Cu alloy material whose end portion (end face 1*p*) is not formed with the nitrided layer 15, for example, the amount of deformation and wear can be reduced.

Example 5

Figure 7A:
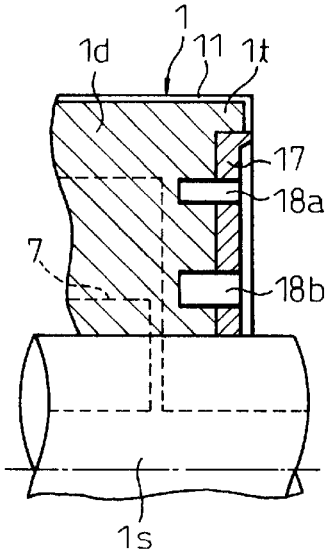
FIG. 7 is a set of explanatory views of a structure of the end portion of a cooling drum that is an embodiment of the present invention, wherein (a) is a partial sectional explanatory view and (b) is a side explanatory view of the structure shown in (a).
Figure 7B:
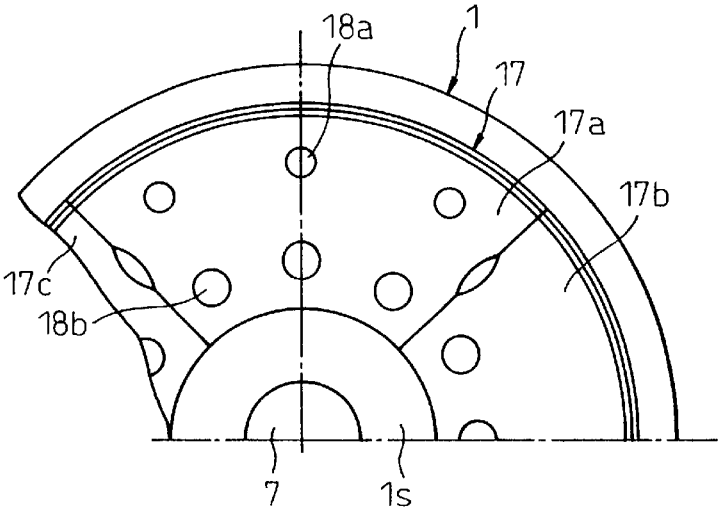

FIG. 7 shows the reinforcing structure of the projecting portion 1*t* of a cooling drum that is an embodiment of the present invention. In this embodiment, the peripheral surface of the drum body portion 1*d*, the peripheral surface of the projecting portion 1*t* and the end face of the projecting portion 1*t* are coated with a Ni plating layer 11. The inner region of the end portion between the projecting portion 1*t* of the body portion 1*d* and the shaft 1*s* of the drum 1 is fastened thereon with a separately fabricated, plate-like reinforcing material 17 of high hardness and high strength. The plate-like reinforcing material 17 supports the projecting portion it and enhances its strength.

The plate-like reinforcing material 17 is formed of four fan-like segments (17*a*–17*d*) which are fastened to the drum body portion 1*d* by two rows of circumferentially spaced bolts 18*a*, 18*b*. The segments 17*a*–17*d* can be detached by unfastening the bolts. The segmentation of the plate-like reinforcing material 17 makes it easier to fabricate and also easier to obtain in the desired shape.

In this embodiment, the drum body portion 1*d* is made of a copper alloy having a thermal conductivity of 350 W/mK, a hardness Hv of 150 and a coefficient of thermal expansion of $18\times10^{-6}/°$ C. The projecting portion 1*t* is made of a deformation/wear resistant Ni—Cr—Mo steel having a thermal conductivity of 16 W/mK, a coefficient of thermal expansion of $13\times10^{-6}/°$ C. and a hardness (Hv 350) greater than that of the copper alloy.

Since the body portion 1*d* is formed of a Cu alloy material that is excellent in thermal conductivity, the end portion therefore also enjoys the cooling effect of the cooling structure 7 via the Cu alloy. The thermal load of the end portion is therefore reduced and the surface temperature of the end portion can be kept near that of the surface of the drum body portion 1*d*. This mitigates nonuniformity of temperature distribution in the axial direction of the drum. As the projecting portion 1*t* is supported by the plate-like high-hardness and -strength reinforcing material 17 (17*a*–17*d*), moreover, it is protected against local deformation.

Example 6

Figure 8A:
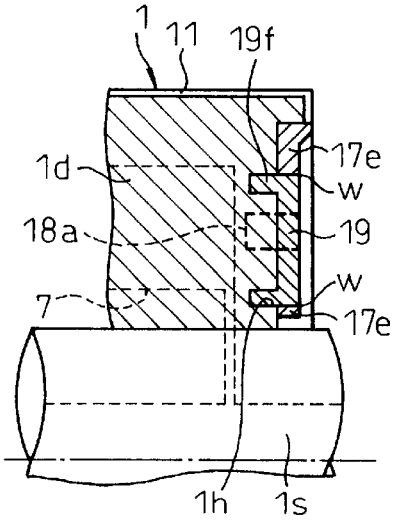
FIG. 8 is a set of explanatory side sectional views of another structure of the end portion of a cooling drum that is an embodiment of the present invention, wherein (a) is a partial sectional explanatory view and (b) is a side explanatory view of the structure shown in (a).
Figure 8B:
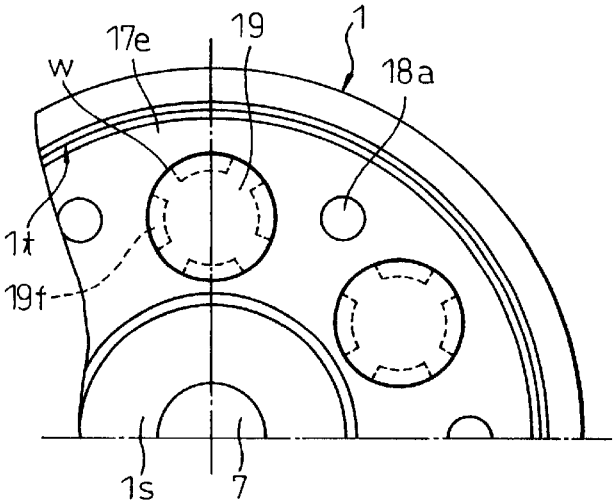

FIG. 8 shows the reinforcing structure of the projecting portion 1*t* of a cooling drum that is another embodiment of the present invention. In this embodiment, the peripheral surface of the drum body portion 1*d*, the peripheral surface of the projecting portion 1*t* and the end face of the projecting portion 1*t* are coated with a Ni plating layer 11. The inner region of the drum end portion between the projecting portion 1*t* of the drum body portion 1*d* and the shaft 1*s* of the drum 1 is mounted thereon with a separately fabricated, plate-like reinforcing material 17*e* of high hardness and strength. The reinforcing material 17*e* supports the projecting portion 1*t* and enhances its strength.

Engagement caps 19 having engagement legs 19*f* are fastened to the plate-like reinforcing material 17*e* by welds w. The engagement legs 17*f* are inserted into engagement holes 1*h* of the drum body portion 1*d* and the plate-like reinforcing material 17*e* is detachably fastened to the drum body portion 1*d* by bolts 18*a*, 18*b*.

In this embodiment, the drum body portion 1*d* is made of a copper alloy having a thermal conductivity of 350 W/mK, a hardness Hv of 150 and a coefficient of thermal expansion of $18\times10^{-6}/°$ C. The plate-like reinforcing material 17*e* and the engagement caps 19 are made of a deformation/wear resistant Ni—Cr—Mo steel having a thermal conductivity of 11 W/mK, a coefficient of thermal expansion of $13\times10^{-6}/°$ C. and a hardness (Hv 450) greater than that of the copper alloy. The engagement caps 19 also function as reinforcing materials.

This embodiment achieves substantially the same effects as the earlier ones as regards reducing the thermal load of the end portion and maintaining the surface temperature of the end portion near that of the surface of the drum body portion 1*d* to thereby mitigate nonuniformity of temperature distribution in the axial direction of the drum. Since part of the end portion is formed with the reinforcing material 17*e* of high hardness and high strength, moreover, the projecting portion 1*t* is reinforced by the plate-like reinforcing material 17*e* made of Ni—Cr—Mo steel and is therefore resistant to deformation and wear.

Example 7

Figure 9A:
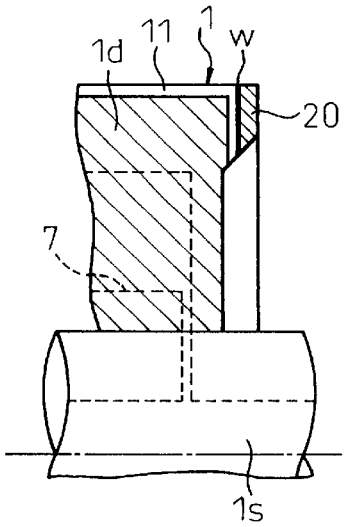
FIG. 9 is a set of explanatory side sectional views of another structure of the end portion of a cooling drum that is an embodiment of the present invention, wherein (a) is a partial sectional explanatory view and (b) is a side explanatory view of the structure shown in (a).
Figure 9B:
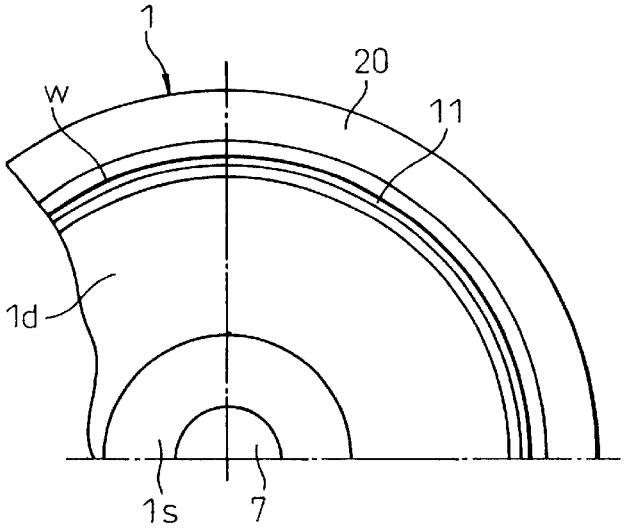

FIG. 9 shows the reinforcing structure of the projecting portion 1*t* of a cooling drum that is another embodiment of the present invention. In this embodiment, the peripheral surface of the drum body portion 1*d*, the peripheral surface of the projecting portion 1*t* and the end face of the projecting portion 1*t* are coated with a Ni plating layer 11. A separately fabricated reinforcing material 20 of high hardness and high strength is joined to the surface of the Ni plating layer 11 by a weld w. The reinforcing material 20 enhances the strength of the projecting portion 1*t*.

In this embodiment, the drum body portion 1*d* is made of a copper alloy having a thermal conductivity of 350 W/mK, a hardness Hv of 150 and a coefficient of thermal expansion of $18\times10^{-6}/°$ C. The welded reinforcing material 20 is made of deformation/wear resistant Inconel (718) having a thermal conductivity of 11 W/mK, a coefficient of thermal expansion of $13\times10^{-6}/°$ C. and a hardness (Hv 450) greater than that of the copper alloy.

This embodiment achieves substantially the same effects as the earlier ones as regards reducing the thermal load of the end portion and maintaining the surface temperature of the end portion near that of the surface of the drum body portion 1*d* to thereby mitigate nonuniformity of temperature distribution in the axial direction of the drum. Since the projecting portion 1*t* is formed with the reinforcing material 20 made of high-hardness, high-strength Inconel, moreover, the projecting portion 1*t* is reinforced and therefore resistant to deformation and wear.

Example 8

Figure 10A:
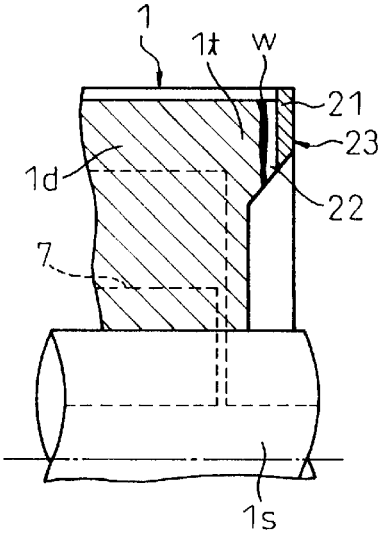
FIG. 10 is a set of explanatory side sectional views of another structure of the end portion of a cooling drum that is an embodiment of the present invention, wherein (a) is a partial sectional explanatory view and (b) is a side explanatory view of the structure shown in (a).
Figure 10B:
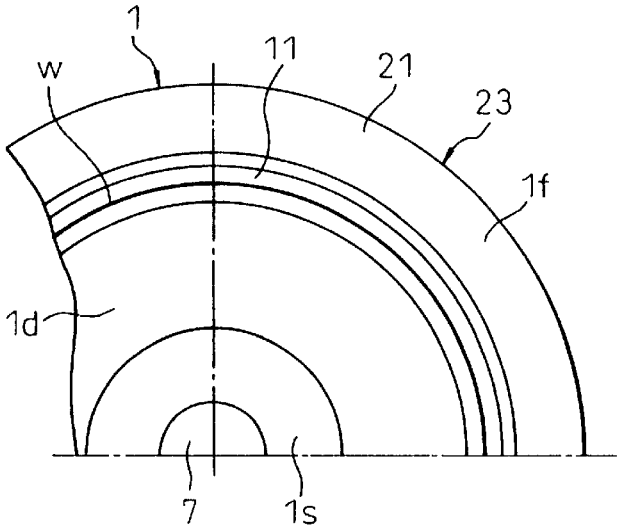

FIG. 10 shows the structure of a cooling drum that is another embodiment of the present invention. In this embodiment, the peripheral surface of the drum body portion 1*d* and the peripheral surface of the projecting portion 1*t* are coated with a Ni plating layer 11. A clad reinforcing material 23 composed of an intermediate material 22 and a high-hardness material 21 and fabricated to match the shape of the projecting portion 1*t* is joined to the projecting portion 1*t* by a weld w. The clad reinforcing material 23 enhances the strength of the projecting portion 1*t*.

In this embodiment, the drum body portion 1*d* is made of a copper alloy having a thermal conductivity of 350 W/mK, a hardness Hv of 150 and a coefficient of thermal expansion of $18\times10^{-6}/°$ C. The intermediate material 22 of the clad reinforcing material 23 is made of a copper alloy having a thermal conductivity of 350 W/mK, a hardness Hv of 150 and a coefficient of thermal expansion of $18\times10^{-6}/°$ C. The high-hardness material 21 thereof is made of deformation/wear resistant stainless steel (SUS630) having a thermal conductivity of 18W/mK, a coefficient of thermal expansion of $11\times10^{-6}/°$ C. and a hardness (Hv 460) greater than that of the copper alloy.

This embodiment achieves substantially the same effects as the earlier ones as regards reducing the thermal load of the end portion and maintaining the surface temperature of the end portion near that of the surface of the drum body portion 1*d* to thereby mitigate nonuniformity of temperature distribution in the axial direction of the drum. Since the projecting portion 1*t* is formed with the clad reinforcing material 23 including the high-hardness material 21 made high-hardness, high-strength stainless steel, moreover, the projecting portion 1*t* is reinforced and therefore resistant to deformation and wear.

Example 9

Figure 11A:
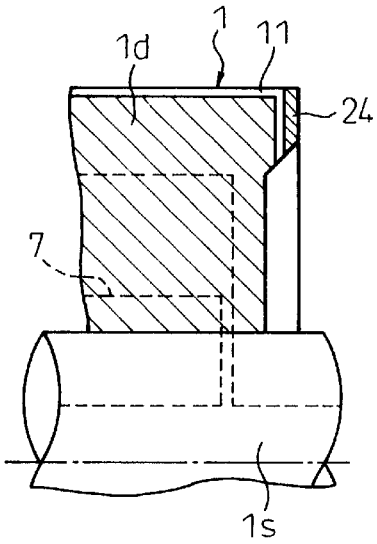
FIG. 11 is a set of explanatory side sectional views of another structure of the end portion of a cooling drum that is an embodiment of the present invention, wherein (a) is a partial sectional explanatory view and (b) is a side explanatory view of the structure shown in (a).
Figure 11B:
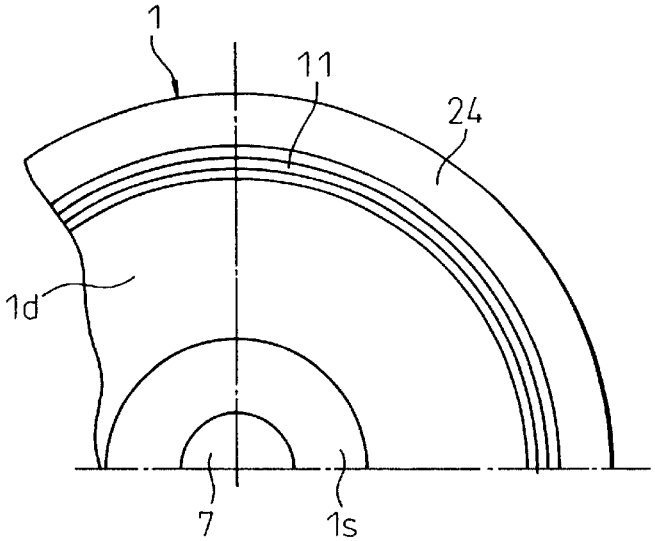

FIG. 11 shows the structure of a cooling drum that is another embodiment of the present invention. In this embodiment, the peripheral surface of the drum body portion 1*d,* the peripheral surface of the projecting portion 1*t* and the end face of the projecting portion 1*t* are coated with a Ni plating layer 11. A reinforcing material 24 of high hardness and high strength is formed on the surface of the Ni plating layer 11 by weld-overlaying. The overlaid reinforcing material 24 enhances the strength of the projecting portion 1*t*.

In this embodiment, the drum body portion 1*d* is made of a copper alloy having a thermal conductivity of 350 W/mK, a hardness Hv of 150 and a coefficient of thermal expansion of $18\times10^{-6}/°$ C. The overlaid reinforcing material 24 is made of deformation/wear resistant Inconel (750) having a thermal conductivity of 11 W/mK, a coefficient of thermal expansion of $13\times10^{-6}/°$ C. and a hardness (Hv 450) much greater than that of the copper alloy.

This embodiment achieves substantially the same effects as the earlier ones as regards reducing the thermal load of the end portion and maintaining the surface temperature of the end portion near that of the surface of the drum body portion 1*d* to thereby mitigate nonuniformity of temperature distribution in the axial direction of the drum. Since the projecting portion 1*t* is formed with the overlaid reinforcing material 24 composed of Inconel of super high hardness and high strength, moreover, the projecting portion 1*t* is reinforced and therefore resistant to deformation and wear.

Example 10

Figure 12A:
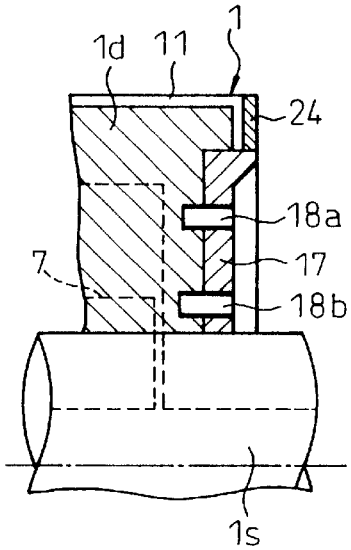
FIG. 12 is a set of explanatory side sectional views of another structure of the end portion of a cooling drum that is an embodiment of the present invention, wherein (a) is a partial sectional explanatory view and (b) is a side explanatory view of the structure shown in (a).
Figure 12B:
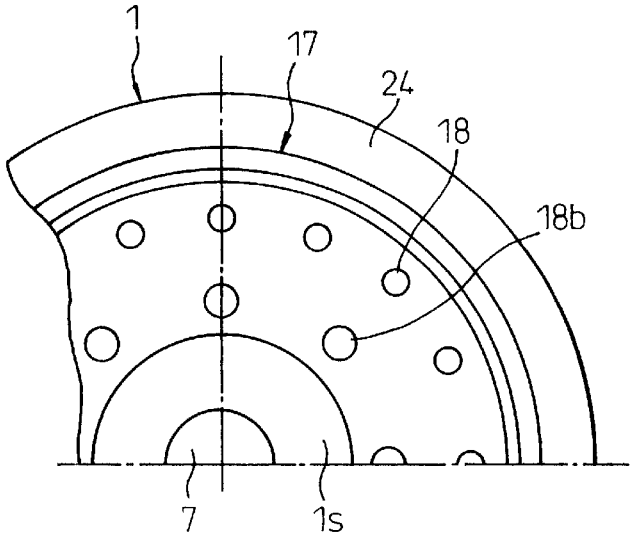

FIG. 12 shows the structure of a cooling drum that is another embodiment of the present invention. In this embodiment, the peripheral surface of the drum body portion 1*d,* the peripheral surface of the projecting portion 1*t* and the end face of the projecting portion 1*t* are coated with a Ni plating layer 11. A reinforcing material 24 of high hardness and high strength is formed on the surface of the Ni plating layer 11 of the projecting portion 1*t* by weld-overlaying. The overlaid reinforcing material 24 enhances the strength of the projecting portion 1*t*. Further, a separately fabricated, plate-like reinforcing material 17 of high hardness and strength is detachably fastened to drum body portion 1*d* at the inner region of the drum end portion by bolts 18*a,* 18*b*. The reinforcing material 17 supports the projecting portion 1*t* and enhances its strength.

In this embodiment, the drum body portion 1*d* is made of a copper alloy having a thermal conductivity of 350 W/mK, a hardness Hv of 150 and a coefficient of thermal expansion of $18\times10^{-6}/°$ C. The overlaid reinforcing material 24 is made of a deformation/wear resistant high-Mn steel having a thermal conductivity of 16 W/mK, a coefficient of thermal expansion of $18\times10^{-6}/°$ C. and a hardness (Hv 550) much greater than that of the copper alloy. The plate-like reinforcing material 17 is made of high-strength stainless steel (SUS630) having a thermal conductivity of 18 W/mK, a coefficient of thermal expansion of $11\times10^{-6}/°$ C. and a hardness (Hv 400) greater than that of the copper alloy.

This embodiment achieves substantially the same effects as the earlier ones as regards reducing the thermal load of the end portion and maintaining the surface temperature of the end portion near that of the surface of the drum body portion 1*d* to thereby mitigate nonuniformity of temperature distribution in the axial direction of the drum. Since the projecting portion 1*t* is formed with the overlaid reinforcing material 24 composed of high-Mn steel of high hardness and high strength, moreover, the projecting portion 1*t* is reinforced. As the projecting portion 1*t* is further supported by the plate-like reinforcing material 17 made of stainless steel of higher strength than the copper alloy, moreover, it is further reinforced and therefore resistant to deformation and wear and reliably protected against local deformation.

Example 11

Figure 13A:
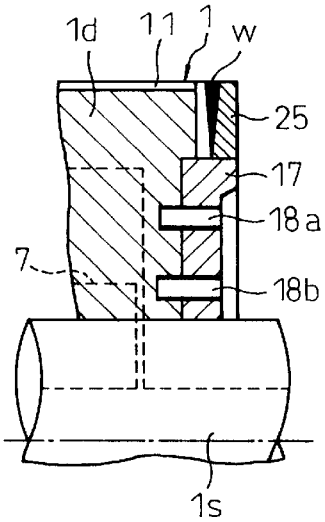
FIG. 13 is a set of explanatory side sectional views of another structure of the end portion of a cooling drum that is an embodiment of the present invention, wherein (a) is a partial sectional explanatory view and (b) is a side explanatory view of the structure shown in (a).
Figure 13B:
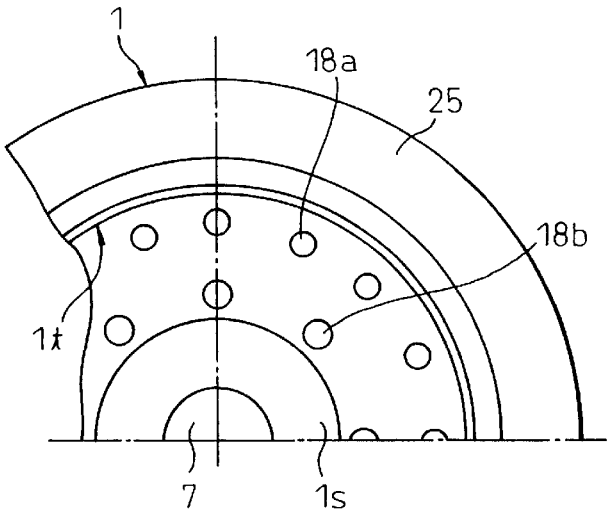

FIG. 13 shows the structure of a cooling drum that is another embodiment of the present invention. In this embodiment, the peripheral surface of the drum body portion 1*d,* the peripheral surface of the projecting portion 1*t* and the end face of the projecting portion 1*t* are coated with a Ni plating layer 11. A separately fabricated reinforcing material 25 of high hardness and high strength is fastened to the surface of the projecting portion 1*t* by a weld w. The welded reinforcing material 25 enhances the strength of the projecting portion 1*t*. Further, a separately fabricated, plate-like reinforcing material 17 of high hardness and strength is detachably fastened to drum body portion 1*d* at the inner region of the drum end portion by bolts 18*a,* 18*b*. The reinforcing material 17 supports the projecting portion 1*t* and enhances its strength.

In this embodiment, the drum body portion 1*d* is made of a copper alloy having a thermal conductivity of 350 W/mK, a hardness Hv of 150 and a coefficient of thermal expansion of $18\times10^{-6}$/° C. The reinforcing material 25 is made of deformation/wear resistant Inconel (718) having a thermal conductivity of 11 W/mK, a coefficient of thermal expansion of $13\times10^{-6}$/° C. and a super high hardness (Hv 450) that is higher than that of the copper alloy. The plate-like reinforcing material 17 is also made of deformation/wear resistant Inconel (718).

This embodiment achieves substantially the same effects as the earlier ones as regards reducing the thermal load of the end portion and maintaining the surface temperature of the end portion near that of the surface of the drum body portion 1*d* to thereby mitigate nonuniformity of temperature distribution in the axial direction of the drum. Since the projecting portion 1*t* is formed with the welded reinforcing material 25 composed of high-hardness, high-strength Inconel, moreover, the projecting portion 1*t* is reinforced. As the projecting portion 1*t* is further supported by the plate-like reinforcing material 17, moreover, it is further reinforced and therefore resistant to deformation and wear and reliably protected against local deformation.

Example 12

Figure 14A:
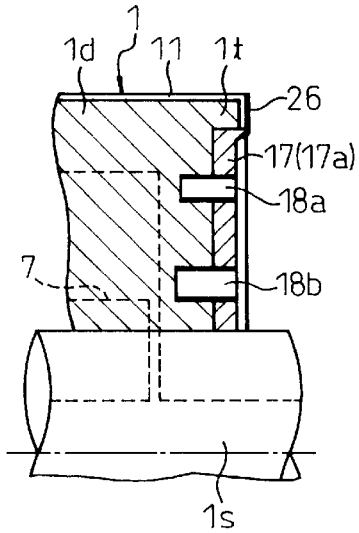
FIG. 14 is a set of explanatory side sectional views of another structure of the end portion of a cooling drum that is an embodiment of the present invention, wherein (a) is a partial sectional explanatory view and (b) is a side explanatory view of the structure shown in (a).
Figure 14B:
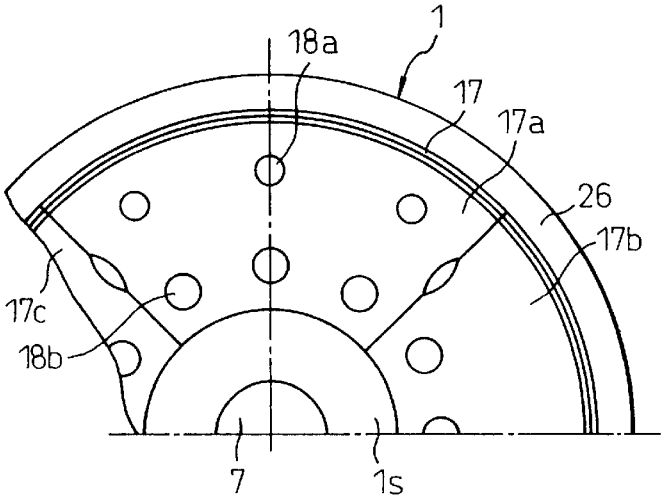

FIG. 14 shows the reinforcing structure of the projecting portion 1*t* of a cooling drum that is an embodiment of the present invention. In this embodiment, the peripheral surface of the drum body portion 1*d,* the peripheral surface of the projecting portion 1*t* and the end face of the projecting portion 1*t* are coated with a Ni plating layer 11. The inner region of the end portion between the projecting portion 1*t* of the body portion 1*d* and the shaft 1*s* of the drum 1 is fastened thereon with a separately fabricated, plate-like reinforcing material 17 of high hardness and high strength. The plate-like reinforcing material 17 supports the projecting portion 1*t* and enhances its strength. The end face of the projecting portion 1*t* that makes pressure-contact with and slides on the side dam is formed by flame spraying with a wear-resistant reinforcing material 26 that, being superior to the Ni plating layer 11 and the plate-like reinforcing material 17 in wear resistance, further reinforces the wear resistance of the projecting portion 1*t*.

The plate-like reinforcing material 17 is formed of four fan-like segments (17*a*–17*d*) which are detachably fastened to the drum body portion 1*d* by two rows of circumferentially spaced bolts 18*a,* 18*b*. The plate-like reinforcing material 17 is segmented for the same reason as explained regarding Example 5.

In this embodiment, the drum body portion 1*d* is made of a copper alloy having a thermal conductivity of 350 W/mK, a hardness Hv of 150 and a coefficient of thermal expansion of $18\times10^{-6}$/° C. The plate-like reinforcing material 17 is made of high-strength stainless steel (SUS410) that has a thermal conductivity of 25 W/mK, a coefficient of thermal expansion of $12\times10^{-6}$/° C. and a hardness (Hv 400) greater than that of the copper alloy and is resistant to deformation and wear. The wear-resistant reinforcing material 26 is made of super-high hardness (Hv 750) tribaloy that is superior to the stainless steel in wear resistance.

This embodiment achieves substantially the same effects as the earlier ones as regards reducing the thermal load of the end portion and maintaining the surface temperature of the end portion near that of the surface of the drum body portion 1*d* to thereby mitigate nonuniformity of temperature distribution in the axial direction of the drum. The projecting portion 1*t* is resistant to deformation and wear because its strength is reinforced by the plate-like reinforcing material 17 made of high-hardness, high-strength stainless steel that is provided at the inner region of the end portion and because the wear-resistant reinforcing material 26 made of tribaloy, a material exhibiting excellent wear resistance, is provided by flame spraying.

Example 13

Figure 15A:
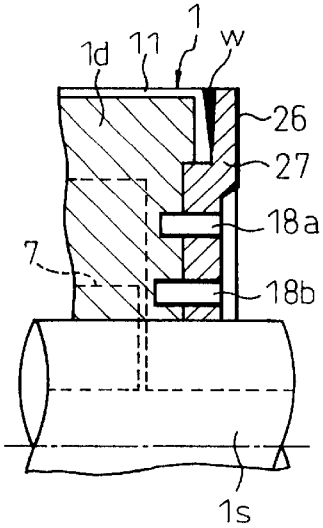
FIG. 15 is a set of explanatory side sectional views of another structure of the end portion of a cooling drum that is an embodiment of the present invention, wherein (a) is a partial sectional explanatory view and (b) is a side explanatory view of the structure shown in (a).
Figure 15B:
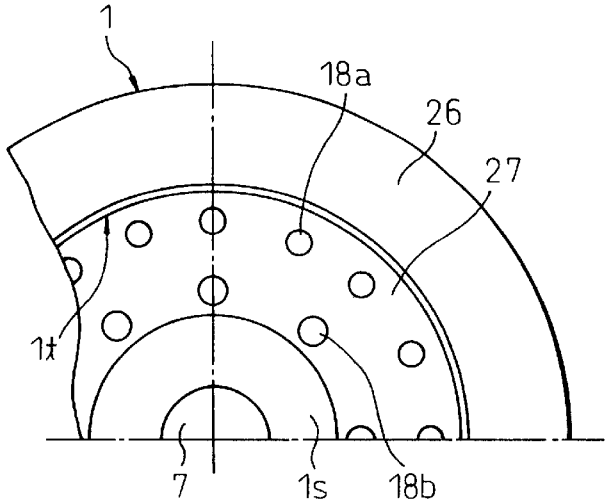
Figure 16A:
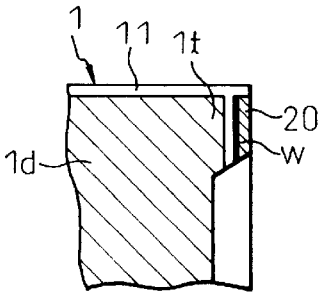
FIGS. 16(*a*)–(*f*) are a set of explanatory side sectional views of other structures of the end portion of cooling drums that are embodiments of the present invention, wherein (a) is a partial sectional explanatory view and (b) is a side explanatory view of the structure shown in (a).
Figure 16B:
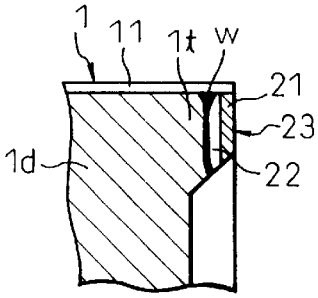
Figure 16C:
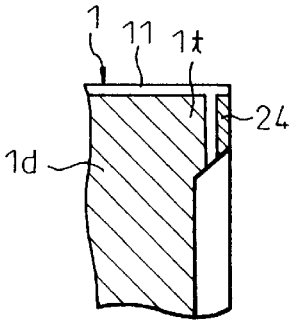
Figure 16D:
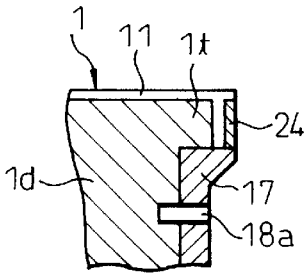
Figure 16E:
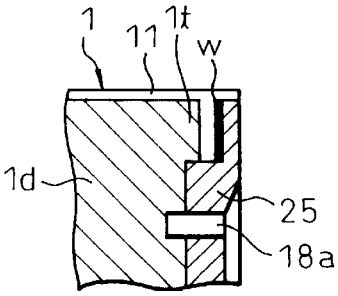
Figure 16F:
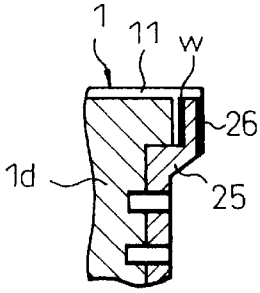

FIG. 15 shows the reinforcing structure of a cooling drum that is another embodiment of the present invention. In this embodiment, the peripheral surface of the drum body portion 1*d,* the peripheral surface of the projecting portion 1*t* and the end face of the projecting portion 1*t* are coated with a Ni plating layer 11. The projecting portion 1*t* and the inner region of the end portion have detachably fastened thereon a separately fabricated reinforcing material 27, which is welded to the projecting portion 1*t* over the Ni plating layer 11 and is bolted to the inner regions of the end portion by bolts 18*a,* 18*b*. The unitary reinforcing material 27 enhances the strength of the projecting portion 1*t*. The end face of the reinforcing material 27 that makes pressure-contact with and slides on the side dam is formed by flame spraying with a wear-resistant reinforcing material 26 that, being formed of a super high hardness material superior to the unitary reinforcing material 27 in wear resistance, further reinforces the wear resistance.

In this embodiment, the drum body portion 1*d* is made of a copper alloy having a thermal conductivity of 350 W/mK, a hardness Hv of 150 and a coefficient of thermal expansion of $18\times10^{-6}$/° C. The unitary reinforcing material 27 is made of deformation/wear resistant Inconel (718) having a thermal conductivity of 11 W/mK, a coefficient of thermal expansion of $13\times10^{-6}$/° C. and a hardness (Hv 450) that is higher than that of the copper alloy. The wear-resistant reinforcing material 26 is made of super high hardness (Hv 800) $Cr_3C_2$ cermet, which is superior to Inconel (718) in wear resistance.

This embodiment achieves substantially the same effects as the earlier ones as regards reducing the thermal load of the end portion and maintaining the surface temperature of the end portion near that of the surface of the drum body portion 1*d* to thereby mitigate nonuniformity of temperature distribution in the axial direction of the drum. The projecting portion 1*t* is strong against deformation and wear and is reliably protected against local deformation because its strength is reinforced by the unitary reinforcing material 27 made of high-hardness, high-strength Inconel 718 integrally provided at the inner region of the drum end portion to be unitary with the projecting portion 1*t* and because this unitary material is further provided thereon with the flame-sprayed wear-resistant reinforcing material 26 of $Cr_3C_2$ cermet, which exhibits outstanding wear resistance.

In the foregoing Examples 7–12, the Ni plating layer 11 is formed as far as the outer peripheral surface of the end face of the projecting portion 1*t* (the end face of the reinforcing material 20, 23, 24, 25 or 27 or of the wear-resistant reinforcing material 26). From the viewpoint of improving the transmission of the cooling effect to the projecting portion 1*t,* however, it is also effective, as shown in FIG. 16 by way of example, to form the Ni plating layer 11 as far as the peripheral surface of the end face of the projecting portion 1*t* (reinforcing material end face) continuous with the peripheral surface of the drum body portion 1*d*. In this case, the order of forming the Ni plating layer 11 and the reinforcing material 20, 23, 24, 25 or 27 or the wear-resistant reinforcing material 26 is changed.

Example 14

Figure 17A:
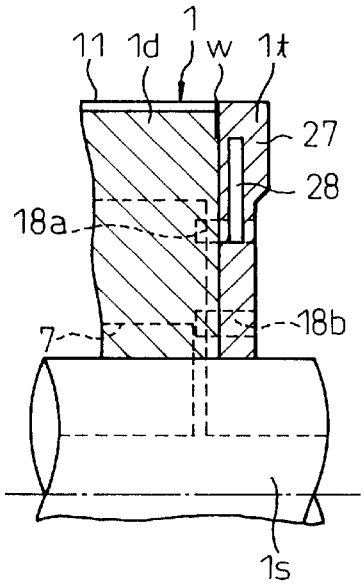
FIG. 17 is a set of explanatory side sectional views of another structure of the end portion of a cooling drum that is an embodiment of the present invention, wherein (a) is a partial sectional explanatory view and (b) is a side explanatory view of the structure shown in (a).
Figure 17B:
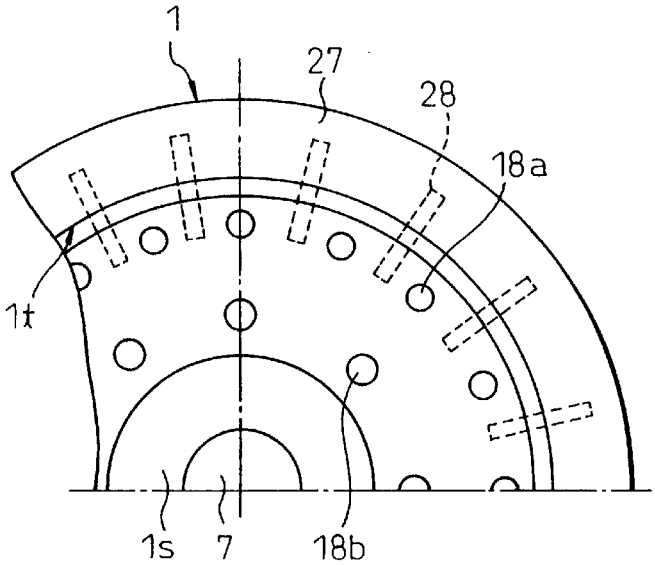

FIG. 17 shows the reinforcing structure of a cooling drum that is another embodiment of the present invention. In this embodiment, the peripheral surface of the drum body portion 1*d*, the peripheral surface of the projecting portion 1*t* and the end face of the projecting portion 1*t* are coated with a Ni plating layer 11. The projecting portion 1*t* and the inner region of the drum end portion are integrally formed in advance as a reinforcing material 27 of high hardness and superior strength having heat pipes 28 incorporated therein. This unitary reinforcing material 27 is fastened to the drum body portion 1*d* by a weld w and bolts 18*a*, 18*b*, whereby the projecting portion 1*t* is reinforced by the unitary reinforcing material 27 and temperature equalizing of the end portion can be achieved owing to the cooling action of the heat pipes 28.

In this embodiment, the drum body portion 1*d* is made of a copper alloy having a thermal conductivity of 350 W/mK, a hardness Hv of 150 and a coefficient of thermal expansion of $18\times10^{-6}$/° C. The unitary reinforcing material 27 is made of deformation/wear resistant Ni—Cr—Mo steel having a thermal conductivity of 16 W/mK, a coefficient of thermal expansion of $13\times10^{-6}$/° C. and a hardness (Hv 350) that is higher than that of the copper alloy.

Figure 18:
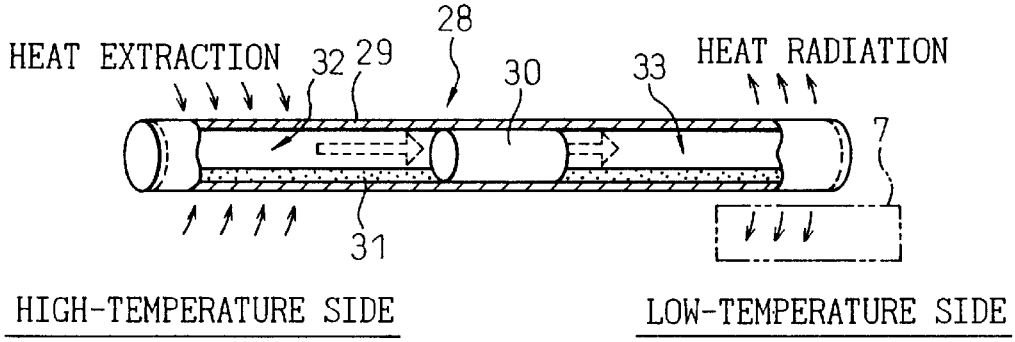
FIG. 18 is a perspective explanatory view of the structure of a heat pipe installed at the end portion of a cooling drum that is an embodiment of the present invention.

The heat pipe 28 is shown conceptually in FIG. 18. It comprises a high-vacuum copper pipe 29, a wick 30 inside the copper pipe for producing capillary attraction, and an operating fluid 31 retained in the copper pipe 29. At the high-temperature side, i.e., the side of the projecting portion 1*t*, the operating fluid 31 absorbs heat and evaporates. Driven by the resulting vapor pressure differential, the vaporized operating fluid 31 travels through the wick 30 toward the low-temperature side at the sonic speed. Upon reaching the low-temperature side, it condenses and releases heat. By this heat transfer action, the heat pipe 28 functions to lower the temperature on the high-temperature side and thus to decrease the temperature difference between the high- and low-temperature sides.

In this embodiment, the evaporator 32 of each heat pipe 28 is positioned on the side of the projecting portion 1*t* and the condenser 33 is positioned near the cooling structure 7. A large number of heat pipes are installed radially at regular spacing.

The heat pipes 28 keep the surface temperature of the projecting portion 1*t* near the surface temperature of the drum body portion 1*d*. This leveling of the temperature distribution in the axial direction of the drum reduces the thermal load. In addition, the projecting portion 1*t* is reliably protected against wear and local deformation because its strength is reinforced by the unitary reinforcing material 27 made of high-hardness, high-strength Ni—Cr—Mo integrally provided at the inner region of the drum end portion to be unitary with the projecting portion 1*t*.

Example 15

Figure 19A:
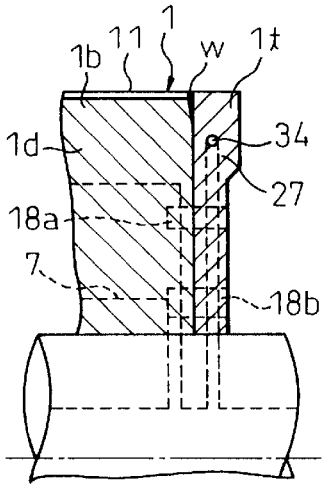
FIG. 19 is a set of explanatory side sectional views of another structure of the end portion of a cooling drum that is an embodiment of the present invention, wherein (a) is a partial sectional explanatory view and (b) is a side explanatory view of the structure shown in (a).
Figure 19B:
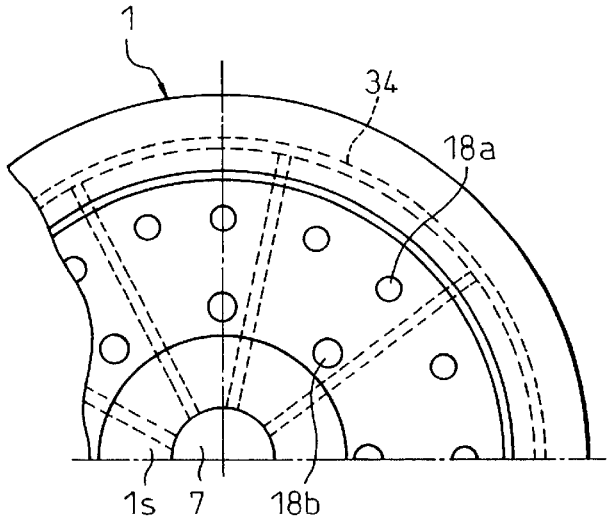

FIG. 19 shows the structure of the end portion of a cooling drum that is another embodiment of the present invention. In this embodiment, the peripheral surface of the drum body portion 1*d* and the peripheral surface of the projecting portion 1*t* are coated with a Ni plating layer 11. The projecting portion 1*t* and the inner region of the drum end portion are integrally formed as a reinforcing material 27 of high hardness and superior strength having cooling water passages 34 incorporated therein. This unitary reinforcing material 27 is fastened to the drum body portion 1*d* by a weld w and bolts 18*a*, 18*b*, whereby the projecting portion 1*t* is reinforced by the unitary reinforcing material 27 and can be cooled by passing water through the cooling water passages 34.

In this embodiment, the drum body portion 1*d* is made of a copper alloy having a thermal conductivity of 350 W/mK, a hardness Hv of 150 and a coefficient of thermal expansion of $18\times10^{-6}$/° C. The unitary reinforcing material 27 is made of deformation/wear resistant Inconel (718) having a thermal conductivity of 11 W/mK, a coefficient of thermal expansion of $13\times10^{-6}$/° C. and a hardness (Hv 450) that is higher than that of the copper alloy. A large number of cooling water passages 34 are installed radially at regular spacing.

Example 16

Figure 20A:
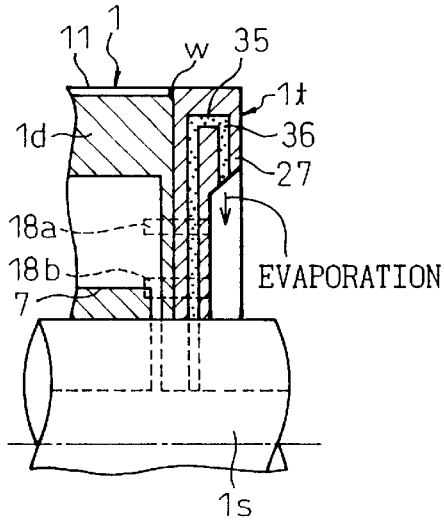
FIG. 20 is a set of explanatory side sectional views of another structure of the end portion of a cooling drum that is an embodiment of the present invention, wherein (a) is a partial sectional explanatory view and (b) is a side explanatory view of the structure shown in (a).
Figure 20B:
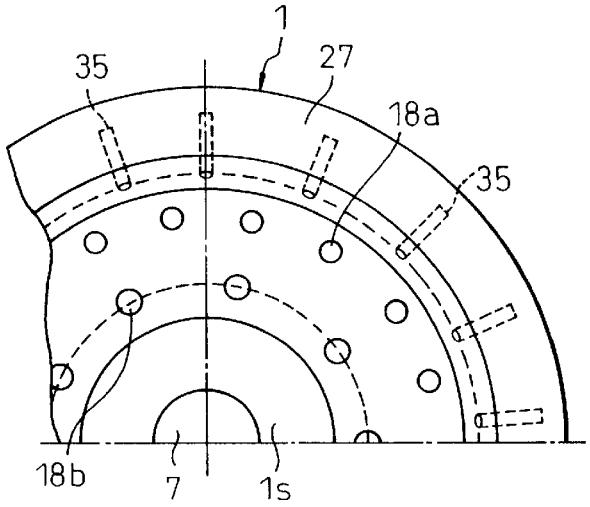
Figure 21A:
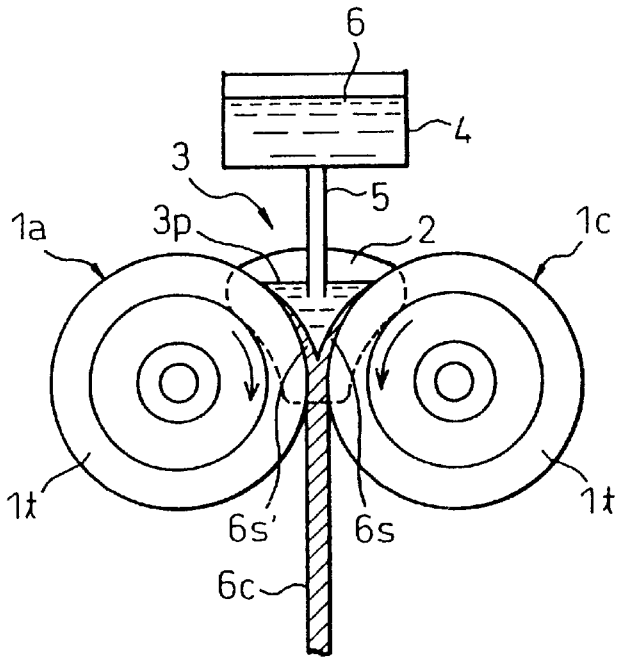
Fig.21(a) Prior Art
FIG. 21 is a set of views showing the basic prior art structure of a twin-drum continuous casting machine in which the cooling drum according to the present invention is utilized, wherein (a) is explanatory side sectional view of the machine and (b) is a sectional view taken longitudinally of the cooling drums in (a).
Figure 21B:
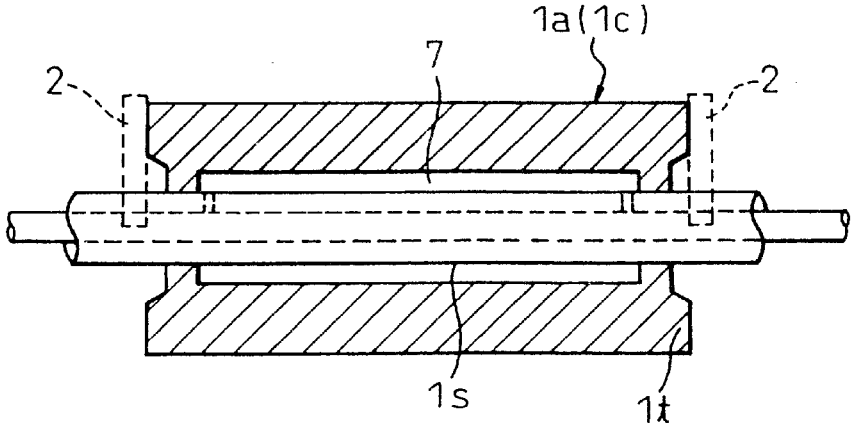
Fig.21(b) Prior Art

FIG. 20 shows the structure of the end portion of a cooling drum that is another embodiment of the present invention. In this embodiment, the projecting portion 1*t* and the inner region of the drum end portion are integrally formed as a reinforcing material 27 of high hardness and superior strength. This unitary reinforcing material 27 is fastened to the drum body portion 1*d* by a weld w and bolts 18*a*, 18*b*, whereby the projecting portion 1*t* is reinforced by the unitary reinforcing material 27. Effusion cooling structures 35 composed of porous material 36 are incorporated in the reinforcing material 27 to enable cooling of the projecting portion 1*t*.

In this embodiment, the drum body portion 1*d* is made of a copper alloy having a thermal conductivity of 350 W/mK, a hardness Hv of 150 and a coefficient of thermal expansion of $18\times10^{-6}$/° C. The unitary reinforcing material 27 is made of deformation/wear resistant stainless steel (SUS630) having a thermal conductivity of 18 W/mK, a coefficient of thermal expansion of $12\times10^{-6}$/° C. and a hardness (Hv 400) that is higher than that of the copper alloy. A large number of cooling water passages 34 are installed radially at regular spacing.

The effusion cooling structures 35 are formed by filling a large number of passages 34 provided radially at regular spacing in the drum end portion with porous material 36 composed of a $SiO_2$-type material. Cooling water absorbed by the porous material 36 seeps out and evaporates at an inclined portion between the projecting portion 1*t* and the end portion of the drum body portion 1*d*. The effusion cooling structures 35 cool the projecting portion 1*t* to keep its surface temperature near the surface temperature of the drum body portion 1*d*. The temperature distribution in the axial direction of the drum is therefore maintained uniform to reduce the thermal load. In addition, the projecting portion 1*t* is reliably protected against wear and local deformation because its strength is reinforced by the unitary reinforcing material 27 made of high-hardness, high-strength stainless steel provided at the inner region of the drum end portion to be unitary with the projecting portion 1*t*.

In the foregoing Examples 14–16, the peripheral surfaces of the drum body portion 1*d* and the projecting portion are not formed with a Ni plating layer or other such heat conducting layer. Like the other embodiments, however, the embodiments of these Examples 14–16 can also be provided on the peripheral surfaces of the drum body portion and the projecting portion 1*t* and the drum end portion (face) with a heat conducting layer like the Ni plating layer 11.

Although various preferred embodiments of the present invention have been disclosed for illustrative purposes, those skilled in the art will appreciate that various modifications, additions and/or substitutions are possible without departing from the scope and spirit of the present invention as disclosed in the claims. For example, alterations as appropriate in light of the side dam specifications (structure, size, shape, combination of materials) and in light of the conditions of the continuous casting operation (temperature, speed, size etc.) are possible as regards any or any combination of the structure and arrangement of the cooling drum cooling structures, the cooling drum specifications (end face material, size, shape, combination of body portion and end portion materials), combination of materials constituting the cladding material, cladding configuration, and selection of method of welding, flame spraying, plating and the like.

Test Examples

The surfaces of side dams under sliding pressure contact by the end faces of the projecting portion 1*t* of the cooling drum were formed of a composite material of $BN+Si_3N_4$ having a Vickers hardness Hv of 200 and 10*t* of thin (3 mm) slab was continuously cast at the rate of 40 m/min. The temperature distribution in the axial direction of the drum during the continuous casting and the wear and local deformation of the end faces of the projecting portions 1*t* after the continuous casting were investigated. The test results and the results of evaluations made relative to a comparative example are set out in the following.

The cooling drum of the comparative example had a drum body portion 1*d* and end portions integrally formed of copper alloy (thermal conductivity of 350 W/mK). The projecting portions 1*t* were formed with 30 μm-thick flame-sprayed films of Co—Cr—Al—Y.

Test Example 1

In the reinforcing structure of the end portion of the cooling drum of the seventh embodiment shown in FIG. 9, the Ni plating layer 11 was formed to a thickness of 1.0 mm and the reinforcing material 20 made of Inconel (718) (thermal conductivity: 11 W/mK, coefficient of thermal expansion: $13\times10^{-6}$/° C.) was separately fabricated to a thickness of 2 mm and joined to the surface of the Ni plating layer 11 by a 1 mm-thick electron-beam weld w. The strength of the projecting portion 1*t* was thus enhanced by the reinforcing material 20.

In this test, the average wear of the end faces of the projecting portions 1*t* of the cooling drum was 0.01 mm, about 1/10 that in the comparative example, and the local deformation of the projecting portion 1*t* was 0.05 mm, about 1/10 that of the comparative example. The average surface temperature of the projecting portions 1*t* during continuous casting was about 50° C. higher than the average surface temperature of the drum body portion 1*d*. A temperature difference of this value had no adverse effect on the casting operation. In the comparative example, the average wear of the end faces of the projecting portions 1*t* was 0.1 mm and the local deformation was 0.5 mm.

Test Example 2

In the reinforcing structure of the end portion of the cooling drum of the ninth embodiment shown in FIG. 11, the Ni plating layer 11 was formed to a thickness of 1.0 mm and the reinforcing material 24 made of Inconel (718) (thermal conductivity: 11 W/mK, coefficient of thermal expansion: $13\times10^{-6}$/° C.) weld-overlaid on the Ni plating layer 11 to a thickness of 1.5 mm. The strength of the projecting portion 1*t* was thus enhanced by the overlaid reinforcing material 24.

In this test, the average wear of the end faces of the projecting portions 1*t* of the cooling drum was 0.01 mm, about 1/10 that in the comparative example, and the local deformation of the projecting portion 1*t* was 0.05 mm, about 1/10 that of the comparative example. The average surface temperature of the projecting portions 1*t* during continuous casting was about 50° C. higher than the average surface temperature of the drum body portion 1*d*. A temperature difference of this value had no adverse effect on the casting operation.

Test Example 3

In the reinforcing structure of the end portion of the cooling drum of the tenth embodiment shown in FIG. 12, the Ni plating layer 11 was formed to a thickness of 1.0 mm and the overlaid reinforcing material 24 made of Ni—Cr—Mo steel (SNCM616) (thermal conductivity: 16 W/mK, coefficient of thermal expansion: $18\times10^{-6}$/° C.) weld-overlaid on the Ni plating layer 11 to a thickness of 2 mm. The strength of the projecting portion 1*t* was thus enhanced by the overlaid reinforcing material 24. The strength of the projecting portion 1*t* was further increased by the plate-like reinforcing material 17, which was formed of stainless steel (SUS630) to a thickness of 4 mm–10 mm.

In this test, the average wear of the end faces of the projecting portions 1*t* of the cooling drum was 0.01 mm, about 1/10 that in the comparative example, and the local deformation of the projecting portion 1*t* was 0.025 mm. In other words, the local deformation was reduced by about an additional 50% compared with that in Test Example 2 using no plate-like reinforcing material 17. The average surface temperature of the projecting portions 1*t* during continuous casting was about 50° C. higher than the average surface temperature of the drum body portion 1*d*. A temperature difference of this value had no adverse effect on the casting operation.

Test Example 4

In the reinforcing structure of the end portion of the cooling drum of the eleventh embodiment shown in FIG. 13, the Ni plating layer 11 was formed to a thickness of 1.0 mm and the reinforcing material 25 made of Inconel (718) (thermal conductivity: 11 W/mK, coefficient of thermal expansion: $13\times10^{-6}$/° C.) was formed to a thickness of 2 mm and welded on the Ni plating layer 11. The strength of the projecting portion 1*t* was thus enhanced by the welded reinforcing material 25. The strength of the projecting portion 1*t* was further increased by the plate-like reinforcing material 17, which was formed of stainless steel (SUS630) to a thickness of 4 mm–10 mm. Super high hardness tribaloy was flame-sprayed on the Inconel to a thickness of 50 μm.

In this test, the average wear of the end faces of the projecting portions 1*t* of the cooling drum was 0.001 mm, about 1/100 that in the comparative example, and the local deformation of the projecting portion 1*t* was 0.025 mm. In other words, the local deformation was reduced by about an additional 50% compared with that in Test Example 2 using no plate-like reinforcing material 17. The average surface temperature of the projecting portions 1*t* during continuous casting was about 50° C. higher than the average surface temperature of the drum body portion 1*d*. A temperature difference of this value had no adverse effect on the casting operation.

Test Example 5

In the reinforcing structure of the end portion of the cooling drum of the fourteenth embodiment shown in FIG. 17, the Ni plating layer 11 was formed to a thickness of 1.0 mm and the drum end portions including the projecting portions 1*t* were reinforced by a unitary reinforcing material 27 of a thickness of 15 mm–10 mm made of Ni—Cr—Mo steel (SNCM616) (thermal conductivity: 16 W/mK, coefficient of thermal expansion: $13\times10^{-6}$/° C.). The projecting portions 1*t* were cooled by the heat pipes 28.

In this test, the average wear of the end faces of the projecting portions 1*t* of the cooling drum was 0.01 mm, about 1/10 that in the comparative example, and the local deformation of the projecting portion 1*t* was 0.01 mm, about 1/50 that in the comparative example. The local deformation was 1/10 better than in the case of not using the heat pipes 28. The average surface temperature of the projecting portions 1*t* during continuous casting was about 10° C. higher than the average surface temperature of the drum body portion 1*d*. A temperature difference of this value had no adverse effect on the casting operation.

This invention reduces thermal load by using copper or copper alloy of high thermal conductivity at the body portion of the cooling drum and uses a high-hardness material, i.e., a material superior in wear resistance and strength to the body portion material, at the drum end portions which tend to be deformed and worn by sliding on the side dams under pressure contact. Deformation and wear of the end portions of the cooling drum are preferably curbed by forming regions thereof extending to a depth (thickness) of 1–20 mm from the end portion surfaces that contact the side dams of high-hardness material having a hardness (Hv) that is twice or more the hardness of the body portion material. In addition, the body portion is preferably formed of a material of high thermal conductivity so as to enable the cooling effect of the internal cooling structure also to reach the end portions through the body portion material, thereby reducing thermal load and mitigating nonuniformity of temperature distribution in the axial direction of the drum. Thus, by ensuring that the cooling drum maintains its shape properties over the long-term, the present invention makes it possible to realize stable continuous casting.

What is claimed is:

1. A cooling drum for a twin-drum continuous casting machine equipped with a pair of cooling drums that rotate in opposite directions and a pair of side dams that abut on opposite end faces of the cooling drums to define a moving mold, the cooling drum comprising a drum body portion formed of a material having high thermal conductivity and end portions formed of a material having higher hardness than the material of the body portion, the end portions having a Vickers hardness Hv (250 g) of 300–600.

2. A cooling drum for a twin-drum continuous casting machine according to claim 1 wherein the drum body portion is formed of copper or copper alloy.

3. A cooling drum for a twin-drum continuous casting machine according to claim 1 wherein the high-hardness material forming the end portions is material of the body portion which has been subjected to nitriding or carbonizing high-hardness treatment.

4. A cooling drum for a twin-drum continuous casting machine according to claim 1 wherein the high-hardness material forming the end portions is material of the body portion welded with a cladding material.

5. A cooling drum for a twin-drum continuous casting machine according to claim 1 wherein the high-hardness material of the end portions is coated with a super high hardness material to a thickness of 10 –500 μm by flame spraying or plating.

6. A cooling drum for a twin-drum continuous casting machine according to claim 1 wherein an outer peripheral surface of the drum body portion or an outer peripheral surface of the drum body portion and outer peripheral surfaces of the end portions are coated with heat conducting layers having a thermal conductivity of not less than 30 W/mK and a thickness of 10–5000 μm by flame spraying or plating.

7. A cooling drum for a twin-drum continuous casting machine according to claim 1 wherein at least outermost surface layers of the drum end portions that are pressure-contacted with and slide on the side dams are coated with super-high hardness material layers of a thickness of 10–500 μm and a Vickers hardness HV (250 g) of 600–1000 by flame spraying or plating.

8. A cooling drum for a twin-drum continuous casting machine equipped with a pair of cooling drums that rotate in opposite directions and a pair of side dams in pressure-contact with opposite end faces of the cooling drums, the cooling drum comprising a drum body portion of a material having a thermal conductivity of 100–400 W/mK and drum end portions part or all of whose portions in pressure-contact with the side dams and/or part or all of whose inner regions are formed of a reinforcing material that is a high-hardness material having a Vickers hardness HV (250 g) of 300–600.

9. A cooling drum for a twin-drum continuous casting machine according to claims 8 wherein the ratio of the coefficient of thermal expansion of the reinforcing material to that of the drum body portion material is 0.5 to 1.2.

10. A cooling drum for a twin-drum continuous casting machine according to claim 8 wherein the reinforcing material is formed of one or more of stainless steel, high-Mn cast steel, Ni—Cr—Mo steel and Inconel.

11. A cooling drum for a twin-drum continuous casting machine according to claim 8 wherein the reinforcing material formed at the inner regions of the drum end portions is detachably fastened mechanically to the drum body portion material.

12. A cooling drum for a twin-drum continuous casting machine according to claim 8 wherein the reinforcing material formed at the drum end portions is joined to the drum body portion material directly or through an intervening plating layer.

13. A cooling drum for a twin-drum continuous casting machine according to claim 12 above, wherein the reinforcing material formed at the drum end portions is supported by reinforcing material provided at the inner regions of the drum end portions.

14. A cooling drum for a twin-drum continuous casting machine according to claim 8 wherein the reinforcing material formed at the drum end portions is integrated with a cladding material that is joined to the drum body portion material and is composed of a material similar to the drum body portion material.

15. A cooling drum for a twin-drum continuous casting machine according to claims 8 wherein the reinforcing material formed at the drum end portions is coated on the drum body portion material directly or through an intervening plating layer by weld-overlaying or flame spraying.

16. A cooling drum for a twin-drum continuous casting machine according to claim 8 wherein the reinforcing material formed at the drum end portions and the reinforcing material formed at the inner regions of the end portions are integrally formed, the reinforcing material formed at the drum end portions is welded to the drum body portion material through an intervening plating layer, and the reinforcing material formed at the inner regions of the drum end portions is detachably fastened mechanically to the drum body portion material.

17. A cooling drum for a twin-drum continuous casting machine according to claim 8 wherein the reinforcing material formed at the inner regions of the drum end portions is segmented in the circumferential direction or radial direction.

18. A cooling drum for a twin-drum continuous casting machine according to claim 8 wherein the reinforcing material is provided with a cooling structure.

19. A cooling drum for a twin-drum continuous casting machine according to claim 18 above, wherein the cooling structure of the reinforcing material is one or a combination of two or more of a heat pipe, a water-cooling structure and an effusion cooling structure.

* * * * *